US008086117B2

(12) United States Patent
Uno et al.

(10) Patent No.: US 8,086,117 B2
(45) Date of Patent: Dec. 27, 2011

(54) IMAGE FORMING APPARATUS AND DEVELOPER REPLENISHING METHOD

(75) Inventors: Mugijirou Uno, Isehara (JP); Takuzi Yoneda, Tokyo (JP); Keiko Matsumoto, Yokohama (JP); Yuki Oshikawa, Yamato (JP)

(73) Assignee: Ricoh Company, Ltd., Tokyo (JP)

( * ) Notice: Subject to any disclaimer, the term of this patent is extended or adjusted under 35 U.S.C. 154(b) by 523 days.

(21) Appl. No.: 12/246,027

(22) Filed: Oct. 6, 2008

(65) Prior Publication Data

US 2009/0110425 A1 Apr. 30, 2009

(30) Foreign Application Priority Data

Oct. 26, 2007 (JP) ..... 2007-278377

(51) Int. Cl.
*G03G 15/08* (2006.01)

(52) U.S. Cl. ..... 399/27; 399/30

(58) Field of Classification Search ..... None
See application file for complete search history.

(56) References Cited

U.S. PATENT DOCUMENTS

| | | | | |
|---|---|---|---|---|
| 5,978,643 | A | 11/1999 | Uno | |
| 6,022,660 | A | 2/2000 | Uno | |
| 6,226,481 | B1 | 5/2001 | Yoneda et al. | |
| 6,512,901 | B2 | 1/2003 | Uno | |
| 7,020,421 | B2 | 3/2006 | Enoki et al. | |
| 7,280,773 | B2 | 10/2007 | Uno | |
| 7,313,347 | B2 | 12/2007 | Shintani et al. | |
| 7,333,744 | B2 | 2/2008 | Shimojo et al. | |
| 7,373,101 | B2 | 5/2008 | Hozumi et al. | |
| 2005/0084272 | A1 * | 4/2005 | Kikuchi | 399/12 |
| 2005/0191067 | A1 * | 9/2005 | Uno | 399/27 |
| 2005/0271420 | A1 | 12/2005 | Arai et al. | |
| 2005/0281593 | A1 | 12/2005 | Ozeki et al. | |
| 2006/0062594 | A1 | 3/2006 | Kawasumi et al. | |
| 2006/0115286 | A1 | 6/2006 | Uchitani et al. | |
| 2006/0133834 | A1 | 6/2006 | Yoneda et al. | |
| 2006/0165422 | A1 | 7/2006 | Kikuchi et al. | |
| 2007/0116494 | A1 | 5/2007 | Uno et al. | |
| 2007/0196123 | A1 | 8/2007 | Mizuishi et al. | |
| 2007/0280742 | A1 | 12/2007 | Matsumoto et al. | |
| 2008/0063434 | A1 | 3/2008 | Uno et al. | |

(Continued)

FOREIGN PATENT DOCUMENTS

JP 4-122962 4/1992

(Continued)

OTHER PUBLICATIONS

Machine translation of JP 2006235009 A.*

(Continued)

*Primary Examiner* — David Gray
*Assistant Examiner* — David Bolduc
(74) *Attorney, Agent, or Firm* — Oblon, Spivak, McClelland, Maier & Neustadt, L.L.P.

(57) ABSTRACT

A switching controller switches from a developer replenishment prohibition mode to a developer replenishment permission mode when the replenishment detection device detects that the developer containing section does not store a prescribed amount of the developer, and from the developer replenishment permission mode to the developer replenishment prohibition mode when a prescribed operation is executed upon completion of replenishment of the developer from the developer containing bottle to the developer containing section. The developer replenishment prohibition mode prohibits the developer replenishment device from replenishing the developer to the developer containing section, while the developer replenishment permission mode permits the developer replenishment device to replenish the developer to the developer containing section.

7 Claims, 17 Drawing Sheets

U.S. PATENT DOCUMENTS

| | | | | |
|---|---|---|---|---|
| 2008/0124136 | A1 | 5/2008 | Oshikawa | |
| 2008/0175628 | A1 | 7/2008 | Kita et al. | |
| 2008/0181630 | A1 | 7/2008 | Matsumoto et al. | |
| 2008/0181670 | A1 | 7/2008 | Tsuda et al. | |
| 2008/0187332 | A1 | 8/2008 | Tsuda et al. | |
| 2009/0022503 | A1 * | 1/2009 | Mae et al. ..... | 399/12 |

FOREIGN PATENT DOCUMENTS

| | | | |
|---|---|---|---|
| JP | 7-199559 | | 8/1995 |
| JP | 2002-365899 | | 12/2002 |
| JP | 2003-131486 | | 5/2003 |
| JP | 2003-302817 | | 10/2003 |
| JP | 2006-84892 | | 3/2006 |
| JP | 2006235009 | A * | 9/2006 |

OTHER PUBLICATIONS

European search report for Applioation No /Patent No. 08165596.1-2209 dated Dec. 15, 2008.*

* cited by examiner

IMAGE FORMING APPARATUS AND DEVELOPER REPLENISHING METHOD

CROSS REFERENCE TO RELATED APPLICATION

This application claims priority under 35 USC §119 to Japanese Patent Application No. 2007-278377, filed on Oct. 26, 2007, the entire contents of which are herein incorporated by reference.

BACKGROUND OF THE INVENTION

1. Field of the Invention

The present invention relates to an image forming apparatus, such as a facsimile, a copier, a printer, etc., and a developer replenishing method.

2. Discussion of the Background Art

Conventionally, various image forming apparatuses employing two-component developer having toner and carrier have been proposed as described in Japanese Patent Application Laid Open No. 2003-57882. When developer is previously filled in a developer container included in a developing device and an image forming apparatus is shipped, the developer scatters from an opening of the developing device, from which a developing roller is partially exposed, because of vibration or inclination of the image forming apparatus during transportation. Further, the developer can possibly deteriorate due to contacting open air through the opening. Thus, a service person generally fills the developer in a vacant developer container when the image forming apparatus arrives at a user site.

Further, a carrier component included in two-component developer deteriorates when repeatedly used, so that a developing performance deteriorates. Thus, the developer including deteriorated carrier stored in the developing device is generally replaced with a new. To replace such developer, a service person calls on a user at a prescribed cycle, and collects old developer, and replenishes new developer in a vacant developer containing section.

To uniformly replenish developer over a short period of time to a new vacant developer containing section or a section emptied by collecting the developer, the inventor is developing an image forming apparatus as described below.

Specifically, when the developing device is attached to the image forming apparatus, a developer containing bottle containing developer is set to a developer inlet, and a conveyance screw for conveying the developer in the developer containing section is driven, so that the developer is replenished to the developer containing section.

To prevent duplicate replenishment of the developer, which is caused due to an error of a service person, a replenishment detection device detects if the developer containing section is vacant when the service person designates a developer replenishing operation via an operation panel or the like. If the replenishment detection device detects that the developer containing section is vacant, the developer is replenished.

When the developer stored in the developer containing bottle is entirely replenished to the developing device, the service person operates the operation panel and starts an initial setting operation, such as sensitivity correction operation for a tone density sensor, etc., so as to form an appropriate toner image.

However, developer in the developer containing bottle sometimes cannot be entirely replenished to the developer containing section because a power supply is sometimes turned off or developer sometimes clogs in the developer containing bottle during the developer replenishing operation. In such a situation, when the developer replenishment operation is attempted again, the developer replenishing operation cannot restarts, because some developer remains in the developer containing section.

Then, the inventor improved the image forming apparatus as follows. When a replenishment detection device detects if a developer containing section is vacant and the determination result is positive (i.e., the developer containing section is vacant), a replenishment permission flag for permitting a developer replenishing operation is raised, and the image forming apparatus is switched to a permission condition in which the image forming apparatus can execute the developer replenishing operation. When a developer replenishing operation is designated, it is detected if the replenishing permission flag is raised, and the developing replenishing operation is executed when the detection result is positive (i.e., the replenishment permission flag is raised). When developer in a developer containing bottle is entirely replenished to the developer containing section, a service person operates an operation panel and switches to a prohibition condition, in which a developer replenishment operation is prohibited, while lowering the replenishment permission flag. When the developer in the developer containing bottle is not entirely replenished to the developer containing section due to turning off of the power supply or clogging of the developer in the developer containing bottle during the developer replenishment operation, and accordingly the developer replenishing operation is executed again, the developer replenishment operation can be executed regardless if the developer containing section is vacant. Because, the replenishment permission flag is raised at the time.

However, a service person possibly forgets lowering the replenishment permission flag and replenishes new developer without collecting deteriorated developer remaining in the developer containing section, resulting in duplicative replenishment of developer.

SUMMARY OF THE INVENTION

The present invention has been made in view of the above noted and another problems and one object of the present invention is to provide a new and noble image forming apparatus. Such an image forming apparatus includes a latent image carrier that carries a latent image, a developing device that develops the latent image with developer, and a developer containing section included in the developing device for containing the developer. Also included are a developer containing bottle attached to the image forming apparatus to store developer, a developer replenishing device that replenishes the developer from the developer containing bottle to the developer containing section, and a replenishment detection device that detects if the developer containing section stores the developer. A switching controller is also provided to switch from a developer replenishment prohibition mode to a developer replenishment permission mode when the replenishment detection device detects that the developer containing section does not store the developer, and from the developer replenishment permission mode to the developer replenishment prohibition mode when a prescribed operation is executed upon completion of replenishment of the developer from the developer containing bottle to the developer containing section. The developer replenishment prohibition mode prohibits the developer replenishment device from replenishing the developer to the developer containing section, while the developer replenishment permission mode permits the developer replenishment device to replenish the developer to the developer containing section.

In another embodiment, a non-volatile memory, wherein said switching controller controls the non-volatile memory to store information of the prohibition and permission modes.

In yet another embodiment, the prescribed operation includes one of an initial setting operation for adjusting sensitivity of a prescribed sensor, an image forming operation, and an image quality adjustment operation.

BRIEF DESCRIPTION OF DRAWINGS

A more complete appreciation of the present invention and many of the attendant advantages thereof will be readily obtained as the same becomes better understood by reference to the following detailed description when considered in connection with the accompanying drawings, wherein.

PREFERRED EMBODIMENTS OF THE PRESENT INVENTION

Figure 1:
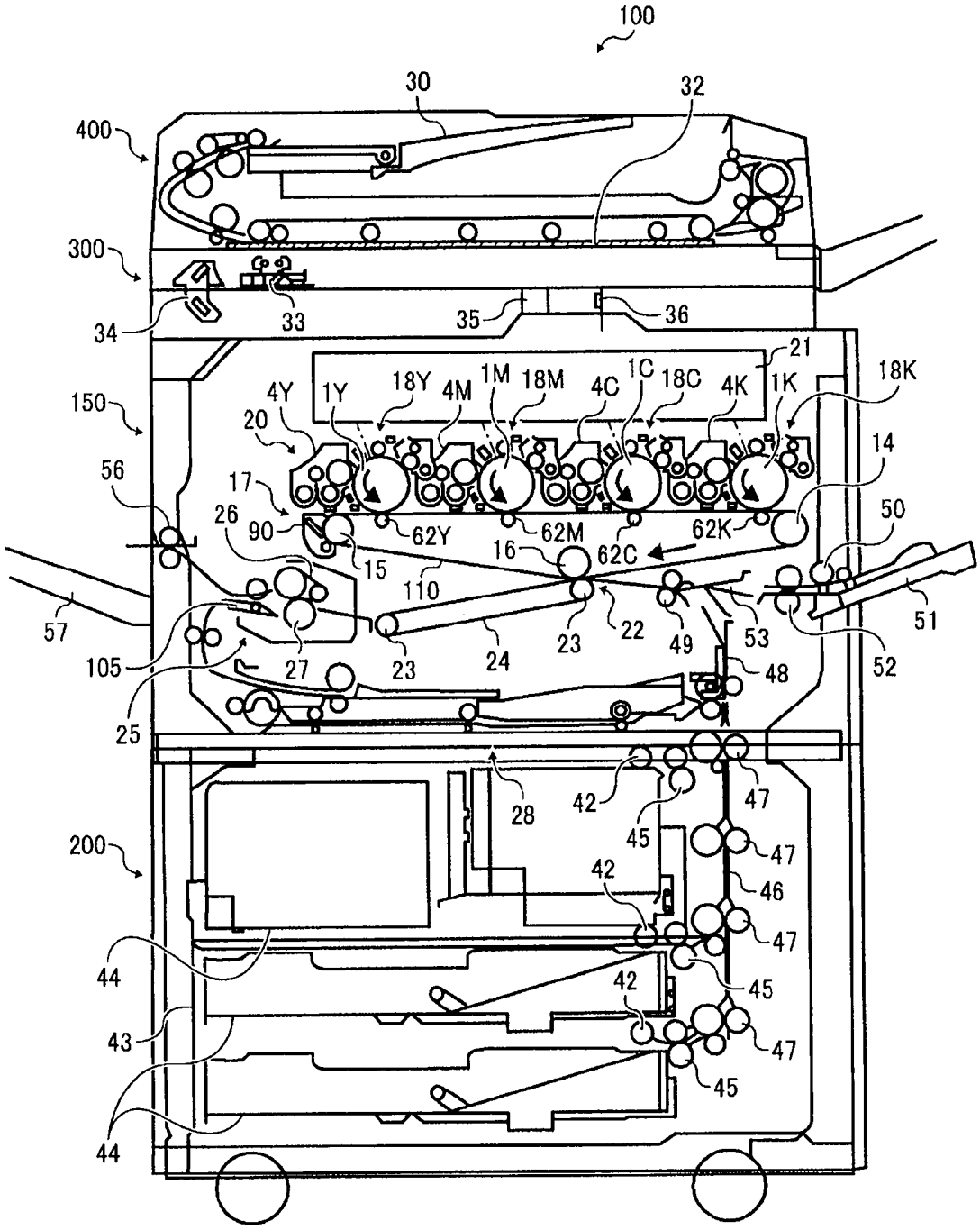
FIG. 1 illustrates an exemplary copier according to one embodiment of the present invention.

Referring now to the drawings, wherein like reference numerals and marks designate identical or corresponding parts throughout several figures, in particular in FIG. 1, one embodiment of the present invention applied to a tandem type color laser copier 100 including plural photoconductive members arranged in parallel is described with reference to FIG. 1. As shown, the copier 100 includes a printing section 150, a sheet feeding device 200 arranged below the printing section 150, and a scanner 300 secured to above the printing section 150, or the like. Also included is an auto document conveyance device 400 secured above the scanner 300.

The printing section 150 includes an image formation unit 20 having four process cartridges 18Y to 18K for forming respective monochrome colors Y to K. Suffixes Y to K represent the monochrome colors of yellow, cyan, magenta, and black, respectively. Beside the process cartridges 18Y to 18K, an optical write unit 21, an intermediate transfer unit 17, a secondary transfer device 22, a pair of registration rollers 49, and a belt type fixing device 25 or the like are arranged.

The optical writing unit 21 includes a light source, not shown, a polygon mirror, an f-theta lens, and a reflection mirror or the like. The optical writing unit 21 emits a laser light to the surface of the photoconductive member in accordance with image data as mentioned later. The process cartridges 18*y* to 18K each includes a drum type photoconductive member 1, a charger, a developing device 4, a drum cleaning device, and a charge-removing device.

Now, the process cartridge 18 for yellow use is typically described. The charger uniformly charges the surface of the photoconductive member 1Y. The laser light modulated and deflected by the optical writing unit 21 is emitted to the surface of the photoconductive member 1Y. As a result, a potential of a light emission receiving section (i.e., an exposure section) decreases, so that a latent image for yellow use is formed on the surface of the photoconductive member 1. The yellow use latent image is developed by a developing device 4Y to be a yellow toner image. The yellow toner image on the surface of the photoconductive member 1Y is transferred onto the intermediate transfer belt 110 as primary transfer. After the primary transfer process, the surface of the photoconductive member 1Y is cleaned by the drum cleaning device while removing not yet transferred toner therefrom. The photoconductive member 1Y is then subjected to a charge removing process of the charge-removing device. When the charger uniformly executes charging, the photoconductive member 1Y returns to an initial condition. The series of the same processes are executed to each of the remaining process cartridges 18M to 18K.

Now, an intermediate transfer unit is described. The intermediate transfer unit 17 includes an intermediate transfer belt 110 and a belt cleaning device 90 or the like. Also included are a suspension roller 15, a driving roller 14, secondary transfer backup roller 16, and four primary transfer bias rollers 62Y to 62K. A tension is applied to the intermediate transfer belt 110 by plural rollers including the suspension roller 14. The intermediate transfer belt 110 is driven and rotated clockwise by a driving roller 15 driven by a belt driving motor, not shown.

The four primary transfer bias rollers 62Y to 62K are arranged contacting the inner surface of the intermediate transfer belt 110 while receiving primary transfer biases from a power supply, not shown. Respective primary transfer nips are formed by depressing these four primary transfer bias rollers 62Y to 62K from the inside of the intermediate transfer belt 110 toward the photoconductive members 1Y to 1K, respectively. Due to influence of the primary transfer bias, a primary transfer electric field is created between the photoconductive member 1 and the primary transfer belt 62 at each of primary transfer nips. Because of the influence of the primary transfer electric field and pressure in the nip, the yellow toner image on the yellow use photoconductive member 1Y is transferred onto the intermediate transfer belt 110 as the primary transfer. On the yellow toner image, M to K color toner images formed on the photoconductive member 1M to 1K are sequentially transferred and superimposed thereon. Thus, four mono color toner superimposed image (i.e., a multi color toner image) is formed on the intermediate transfer belt 110. The four color superimposed toner image on the intermediate transfer belt 110 is transferred onto a transfer sheet as secondary transfer. Toner remaining after the transfer process on the surface downstream of the secondary transfer nip of the intermediate transfer belt 110 is cleaned by the belt cleaning device 90 that sandwiches the intermediate transfer belt with the left side driving roller 15 in the drawing.

Now, a secondary transfer device 22 is described with reference to FIG. 1. Below the intermediate transfer unit 110, a sheet conveyance belt 24 is suspended by a pair of suspension rollers 23 as a secondary transfer device 22. The sheet conveyance belt 24 is endlessly moved counterclockwise as at least one of the suspension rollers 23 rotates. The right side suspension roller 23 in the drawing sandwiches the intermediate transfer belt 110 and the sheet conveyance belt 24 with a secondary transfer backup roller 16 of the intermediate transfer unit 17. Thus, a secondary transfer nip is formed, in which the intermediate transfer belt 110 and the sheet conveyance belt 24 contacts each other. To one of the suspension rollers 23, a secondary transfer bias having a polarity opposite to that of toner is applied by a power supply, not shown. Due to application of the secondary transfer bias, a secondary transfer electric field is created in the secondary transfer nip to electro-statically move a four color toner superimposed image on the intermediate transfer belt 110 from the belt side to the suspension roller 23 side. When a transfer sheet is fed to the secondary transfer nip by a below mentioned pair of registration rollers 49 in synchronism with the four color toner superimposed image on the intermediate transfer belt 110, the four color toner superimposed image is secondary transferred thereonto under the influence of the secondary transfer electric field and pressure at the nip. Instead of such a secondary transfer system in which the secondary transfer bias is applied to one of the suspension rollers 23, a non-contact type charger for charging a sheet can be employed.

In a sheet feeding device 200 arranged at a lower section of the copier 100, plural sheet cassettes each accommodating a stack of plural sheets are piled up vertically. Plural sheet feed rollers 42 pressure contact topmost sheets of the respective sheet feeding cassettes 44, and launch the top most sheets toward a sheet feeding passage when rotated.

The sheet feed passage 46 for receiving the transfer sheet from the sheet-feeding cassette 44 includes plural pair of conveyance rollers 47 and a pair of registration rollers 49 arranged in the vicinity of the end of the passage. The sheet feed passage 46 conveys the transfer sheet toward the pair of registration rollers 49. The transfer sheet conveyed toward the pair of registration rollers 49 is pinched by the pair of registration rollers 49 therebetween. In an intermediate transfer unit 17, the four-color toner superimposed image formed on the intermediate transfer belt 110 enters the secondary transfer nip as the belt rotates. The pair of registration rollers 49 feed the transfer sheet pinched between the pair of registration rollers 49 so that the transfer sheet can tightly contact the four color toner superimposed image in the secondary transfer nip. Then, the transfer sheet tightly contacts the four color toner superimposed image in the secondary transfer nip, thereby carrying a full color image on the transfer sheet while receiving secondary transfer. Then, the transfer sheet with the full color image is ejected from the secondary transfer nip as the sheet conveyance belt 24 endlessly moves toward a fixing device 25.

The fixing device 25 includes a belt unit having two rollers for suspending and rotating the fixing belt endlessly. Also included is a pressure-applying roller 27 depressed toward one of the rollers of the belt unit. The fixing belt 26 and the pressure applying roller 27 contact each other and form a fixing nip therebetween to pinch a transfer sheet fed from the sheet conveyance belt 24. One of two rollers of the belt unit, which is depressed by the pressure-applying roller 27 includes a heat source, not shown, and pressure contacts the fixing belt 26 with heat. The fixing belt 26 receiving the pressure applies heat to the transfer sheet in the fixing nip. Under the influence of the heat and pressure in the nip, the full color image is fixed onto the transfer sheet.

The transfer sheet is then either stacked on a sheet stack section 57 arranged on the left side periphery of the printer or returned to the secondary transfer nip for the purpose of forming a toner image on another side thereof.

When a copy is to be made, a stack of sheet like original documents is set on an original document setting table 30 arranged on an automatic document conveying device 400. However, when the original document is book like, the original document is set on a contact glass 32 of a scanner 300. Before setting the book like original document, the automatic document conveying device 400 is swung to expose the contact glass 32, and is closed to depress the book like original document.

When the book like original document is set and a copy start switch, not shown, is turned on, the scanner starts reading the original document. When the sheet like original document is set onto the automatic document conveying device 400, the automatic document conveying device 400 automatically feeds the original document to the contact glass 32 before reading the original document. During reading of the original document, first and second carriage members 33 and 34 start running, while a light source arranged on the first carriage emits light. Reflection light from the original document is further reflected by a mirror arranged on the second carriage member 34 and enters a reading sensor 36 through an imaging lens. The reading sensor 36 generates image information based on the incident light.

In parallel to such an original document reading operation, each of devices in each of the process cartridges 18Y to 18K, the intermediate transfer unit 17, the secondary transfer device 22, and the fixing device 25 start operating. Then, the optical write unit 21 is controlled to be driven based on the image information generated by the reading sensor 36. Toner images of Y to K colors are then formed on the respective photoconductive members 1Y to 1K. These toner images are transferred and superimposed on the intermediate transfer belt 110 to be a four-color toner superimposed image.

Further, substantially at the same time when the original document is read, the sheet feeding device 200 starts feeding sheets. Specifically, one of sheet feeding rollers 42 is selectively rotated and feeds a transfer sheet from one of the plural sheet feeding cassettes 44 arranged in a paper bank 43. The transfer sheets fed are separated by a separation roller 45 one by one and enters a reversing passage 46. The transfer sheet is then fed toward the secondary transfer nip by a pair of conveyance rollers 47. Instead of the sheet-feeding cassette 44, a sheet is sometimes fed from a manual sheet-feeding tray 51. In such a situation, a manual sheet-feeding roller 50 is selectively rotated and launches transfer sheets on the manual sheet-feeding tray 51. Then, the separation roller 52 separates the transfer sheets one by one and further feeds the transfer sheet to a manual sheet feeding passage 53 arranged in the printer 150.

When the copier 100 forms a multi color toner image including more than dual colors, the intermediate transfer belt 110 is kept with its upper suspension surface being almost horizontal contacting the entire photoconductive members 1Y to 1K. In contrast, when a monochrome image of a black color is formed, the intermediate transfer belt 110 is inclined to the lower left side in the drawing by a mechanism as mentioned later. Then, only the photoconductive member 1K for the black color use is rotated counterclockwise among the four photoconductive members 1Y to 1K and forms only a black color. At this moment, beside the photoconductive members 1 for Y to C color uses, developing devices thereof are stopped rotating to prevent the developer from wearing.

The copier 100 includes a control section, not shown, having a CPU or the like for generally controlling below described devices arranged therein and an operation display section having a liquid crystal display or a various key bottoms. An operator can select one of three one-side modes, such as a print mode for forming an image only on one side surface of the transfer sheet, etc., by operating a key on the operation display. The three modes of the one-side printing mode include a direct ejection mode, a reversed ejection mode, and a reversed decal ejection mode.

Figure 2:
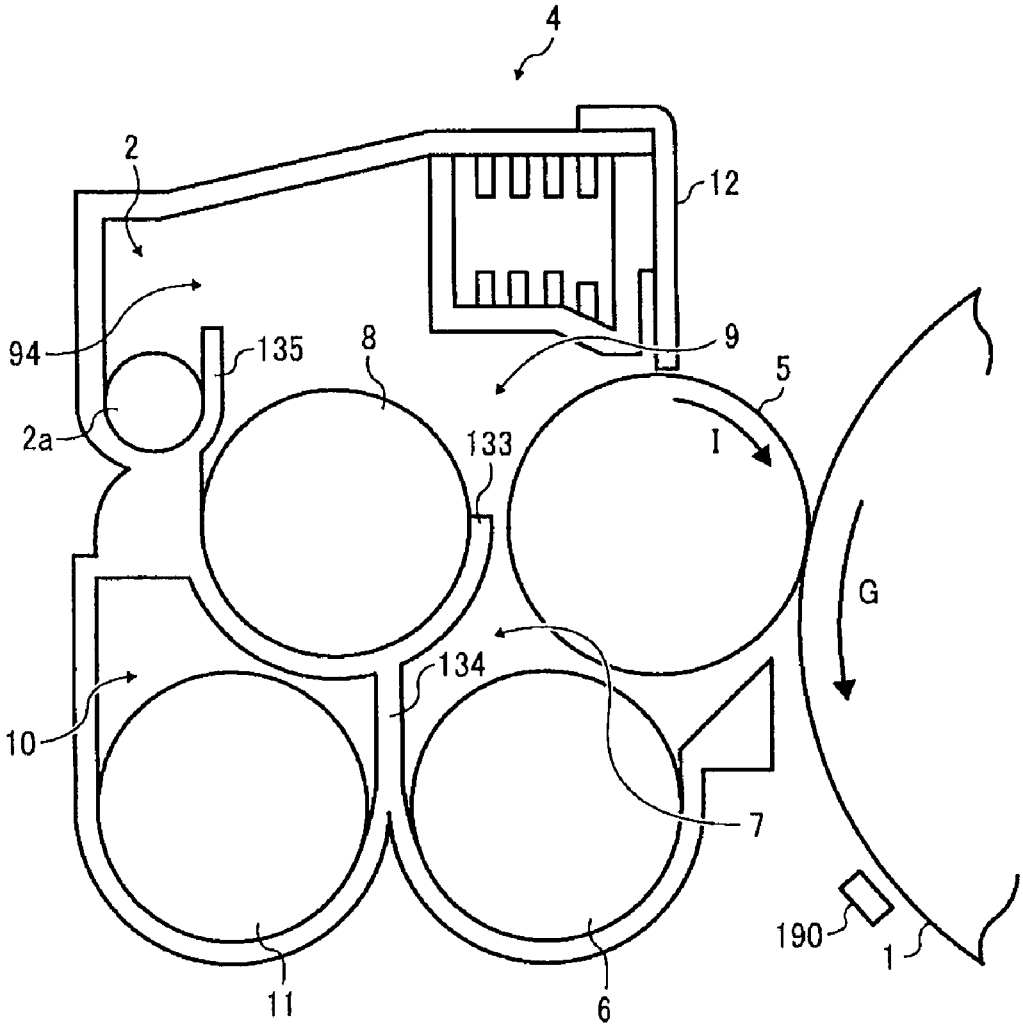
FIG. 2 illustrates an exemplary developing device and an exemplary photoconductive member included in the copier of FIG. 1.

FIG. 2 illustrates the developing device 4 and the photoconductive member 1 included in one of the process cartridges 18*y* to 18K. Since the construction of the four process cartridges 18Y to 18K are almost the same to each other except mono-color of toner, suffixes Y to K of the number 4 are omitted. As shown, the photoconductive member 1 is charged by a charge device, not shown, when rotated in a direction as shown by an arrow G. A latent image is formed by emitting a laser light from the optical write unit 21 to the surface of the photoconductive member 1 with charge. The developing device 4 supplies toner to the latent image, so that a toner image is formed thereon.

The developing device 4 includes a developing roller 5 that supplies toner to the surface of the photoconductive member 1 to execute development while rotating in a direction as shown by an arrow I. Further, the developer containing section includes a supply path. Also included are a stirring conveyance path, and a collection conveyance path, as well as a developer conveyance member for conveying developer to each of the paths. The supply conveyance path includes a supply screw 8 for conveying the developer to a rear side in the drawing and supplying the developer to the developing roller 5. The supply screw 8 includes a rotary shaft and a wing section attached to the rotary shaft and conveys the developer in a direction in parallel to the shaft by its own rotation. In the downstream of a section in which the supply screw 8 opposes the developing roller 5, a developing doctor 12 is arranged to flatten the developer supplied to the developing roller with a prescribed thickness appropriate for development. In the downstream of a developing section in which the developing roller 5 opposes the photoconductive member 1, a collection screw 6 is arranged to collect and convey the developer not used in the developing process and passing through the developing section in the same direction as the supply screw conveys. The supply conveyance path 9 including the supply screw 8 is arranged beside the developing roller 5, while the collection conveyance path 7 including the collection screw 6 is arranged below the developing roller 5. A supply screw 6 also includes a rotary shaft and a wing section attached to the rotary shaft to convey the developer in a direction in parallel to the shaft by its own rotation.

The developing device 4 includes a stirring conveyance path 10 arranged in parallel to the collection conveyance path 7 below the supply conveyance path 9. The stirring conveyance path 10 includes a stirring screw 11 for stirring and conveying the developer to a front side in an opposite direction to that of the supply screw 8. The stirring screw 11 also includes a rotary shaft and a wing section attached to the rotary shaft to convey the developer in a direction in parallel to the shaft by its own rotation. The supply conveyance path 9 and the stirring conveyance path 10 are separated by a first partition wall 133. The first partition wall 133 includes openings at both front and rear side ends so that the supply conveyance path 9 is communicated with the stirring conveyance path 10. The supply path 9 and the collection conveyance path 7 are also separated by the first partition wall 133. However, the first partition wall 133 does not include an opening on the first partition wall 133. The stirring and collection conveyance paths 10 and 7 are also separated by a second partition wall 134. The second partition wall 134 includes an opening at a front side in the drawing so that the stirring conveyance path 10 is communicated with the collection conveyance path 7. Further, the collection and stirring conveyance paths 7 and 10 collectively constitute the developer containing section of the developing device 4.

The developer not used by the developing process is collected and conveyed by the collection conveyance path 7 to a front side in the drawing and is further transferred to the stirring conveyance path 10 through the opening of the first partition wall 133 arranged in a non image region. Premix toner including carrier is replenished to the stirring conveyance path 10 from a toner-replenishing inlet arranged on the stirring conveyance path 10 in the vicinity of the opening of the first partition wall 133 arranged upstream of the stirring conveyance path 10.

Figure 3:
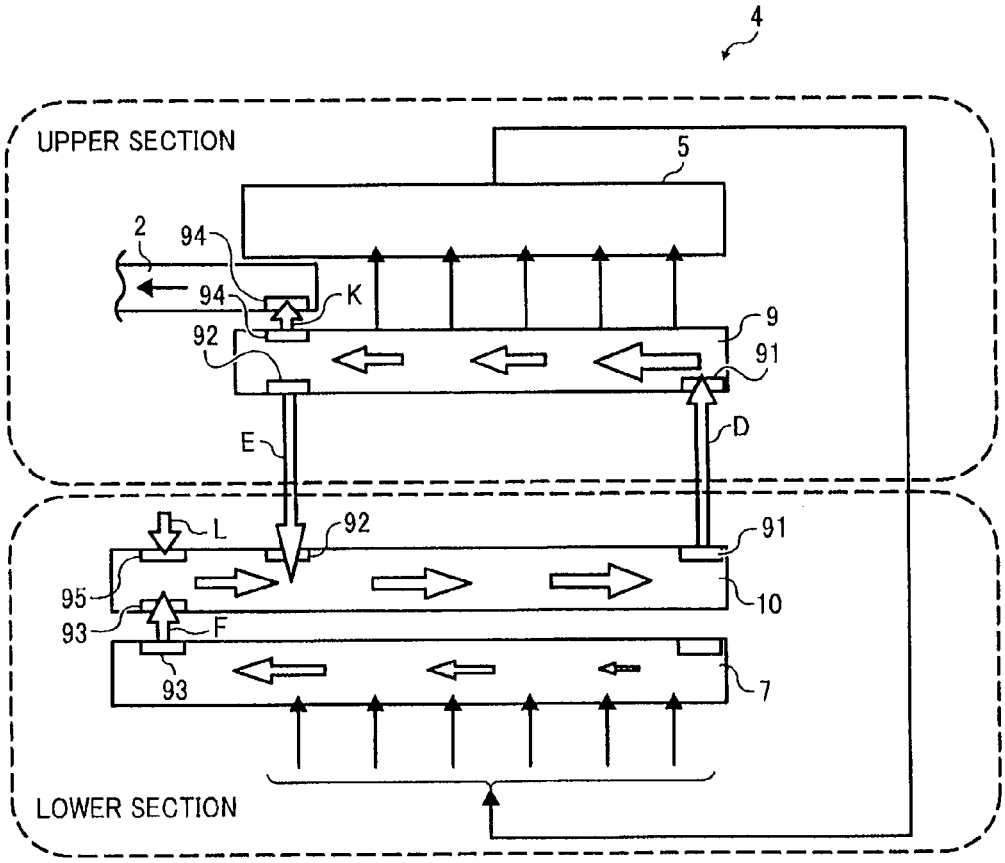
FIG. 3 illustrates an exemplary flow of the developer formed in a developing device included in the copier of FIG. 1.

Now, exemplary circulation of the developer in the developer containing section is described with reference to FIG. 3, where respective arrows represent moving directions of the developer.

Upon receiving the developer from the stirring conveyance path 10, the supply conveyance path 9 conveys the developer to the developing roller 5 while conveying the developer downstream of the supply screw 8. The developer supplied but not used by the developing roller 5 and conveyed to the downstream end of the supply conveyance path 9 is further conveyed to the stirring conveyance path 10 through an extra opening 92 formed on the first partition wall 133 as shown by an arrow E. The developer conveyed from the developing roller 5 to the downstream end of the collection conveyance path 7 by the collection screw 6 is supplied to the stirring conveyance path 10 through a collection opening 93 arranged on the second partition wall 134 as shown by an arrow F. The stirring conveyance path 10 then stirs and transfers the supplied extra developer and the collected developer to a section downstream of the stirring screw 11 and upstream of the supply screw 8, so that the developer is stirred and supplied to the supply conveyance path 9 through a supply opening 91 formed on the first partition wall 133 as shown by an arrow D.

The stirring conveyance path 10 stirs and conveys all of the collected developer, the extra developer, and premix toner supplied from a toner replenishing inlet 95 upon need by means of the stirring screw 11 in an opposite direction to that the developer is conveyed in the collection and supply conveyance paths 7 and 9. Then, the developer thus stirred is transferred to upstream of the supply conveyance path 9. Below the stirring conveyance path 10, a toner density sensor, not shown, is arranged so that the below mentioned toner replenishment device is operated and toner is replenished from a toner container based on an output of the sensor.

Figure 4:
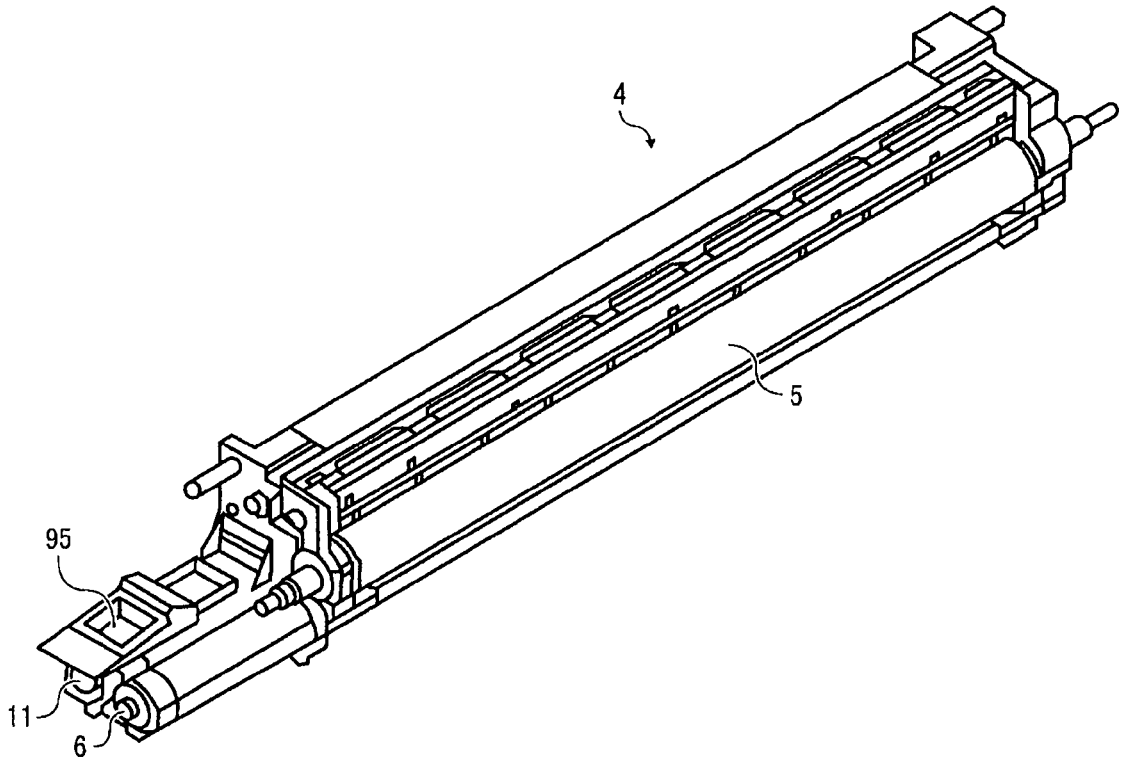
FIG. 4 illustrates an exemplary outline of the developing device of FIG. 2.

Since the developing device of FIG. 4 includes the supply and collection conveyance paths 9 and 7 to separately execute supply and collection of developer, the developer does not enter the supply conveyance path 9. Thus, it can be prevented that toner density of the developer to be supplied to the developing roller 5 decreases in proportion to a downstream side of the supply conveyance path 9 in the conveyance direction. Further, since the collection conveyance path 7 and the stirring conveyance path 10 are provided to separately execute developer collection and stirring, the developer does not drop in a stirring section. Accordingly, developer supplied to the supply conveyance path 9 is sufficiently stirred. In this way, since it can be prevented that toner density of the developer in the supply conveyance path 9 decreases and the developer lacks stirring, image density can be constant during the development.

Now, exemplary positions on a developer conveyance path including all of the supply conveyance path 9, the stirring conveyance path 10, and the collection conveyance path 7, to which toner is replenished, are described with reference to FIG. 4. As shown, a toner replenishment inlet 95 for replenishing toner is arranged above the upstream of the stirring conveyance path 10 at an outside of a widthwise end of the developing roller 5. However, the toner replenishment inlet 95 can be arranged above the downstream end rather than the upstream end. Further, the toner replenishment inlet 95 can be arranged right above the collection opening 93 where the developer is transferred from the collection conveyance path 7 to the stirring conveyance path 10. Since the developer tends to mix at the collection opening section 93 when replenished at the position, the developer can more efficiently be stirred.

Figure 5:
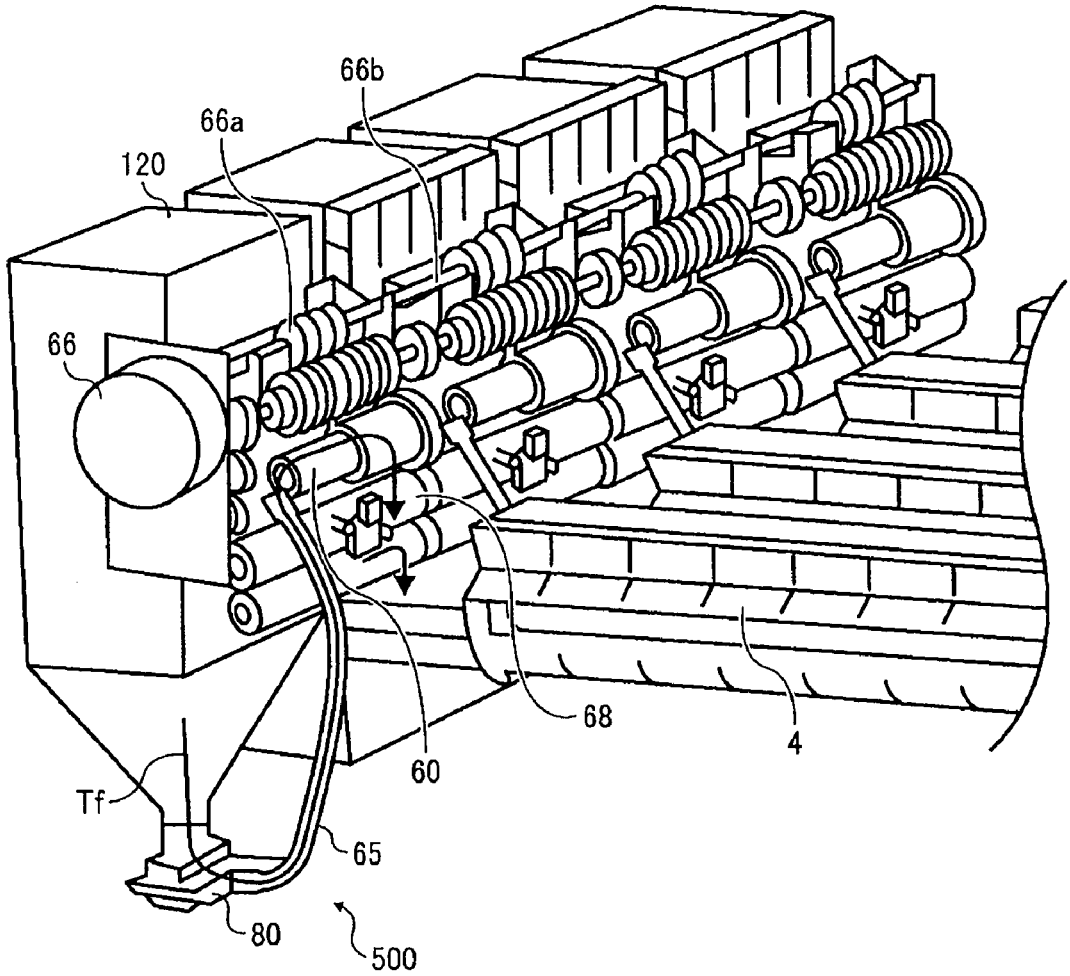
FIG. 5 is a perspective view of an exemplary toner replenishing device included in the developing device of FIG. 2.
Figure 6:
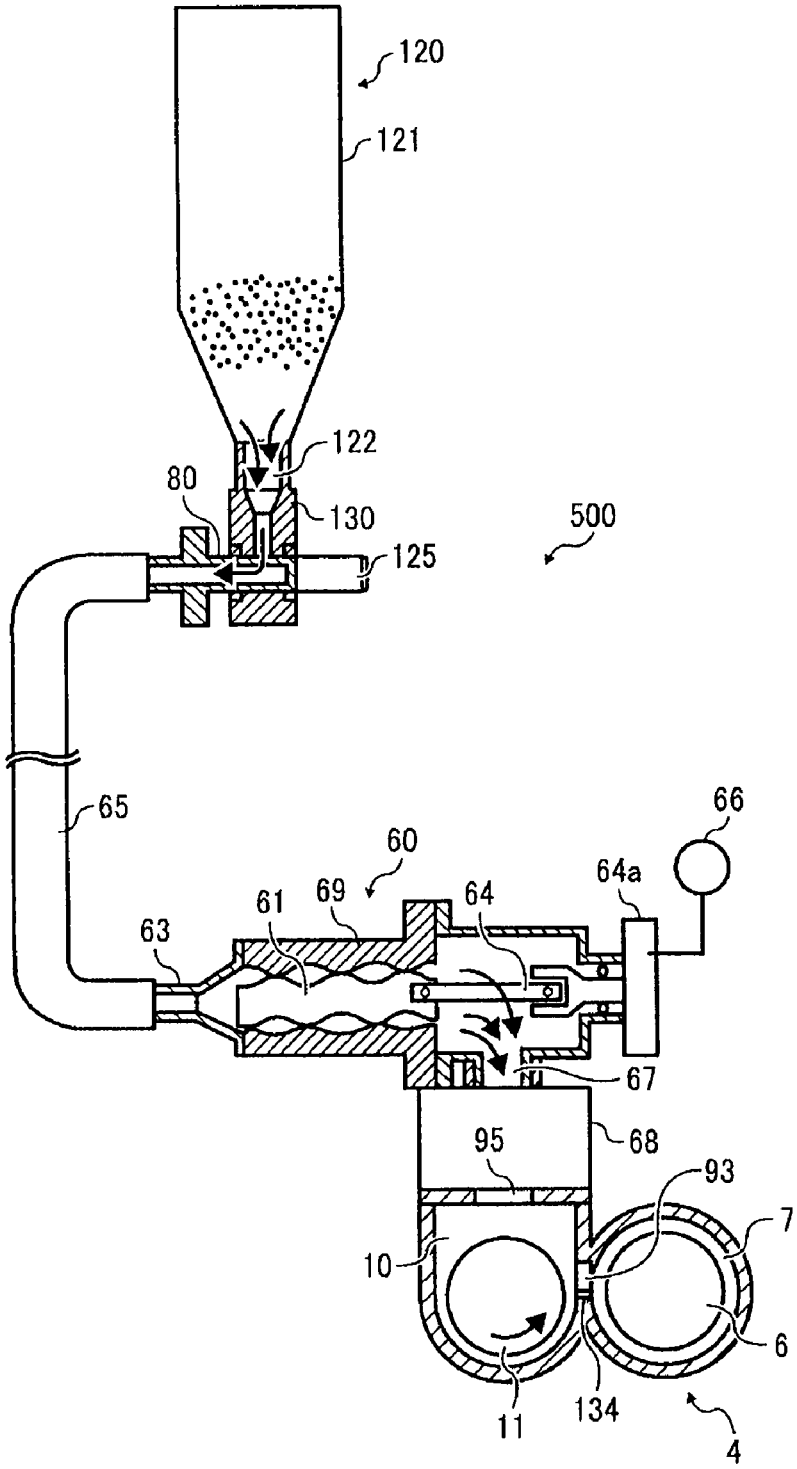
FIG. 6 is a cross sectional view of the exemplary toner replenishing device of FIG. 5.
Figure 7:
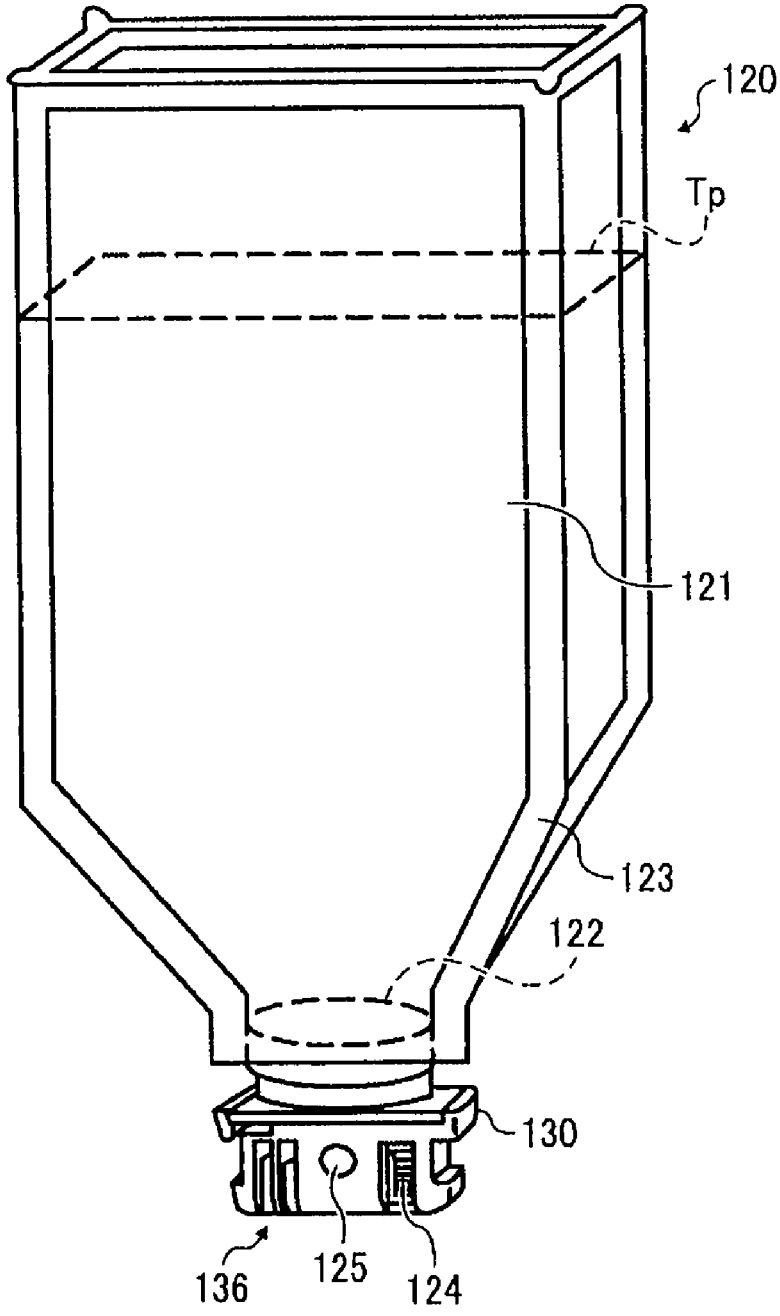
FIG. 7 illustrates an exemplary toner bottle attached to the developing device of FIG. 5.

Now, an exemplary toner replenishing device 500 for replenishing premix toner to the developing device 4 through the toner replenishment inlet 95 is described with reference to FIGS. 5 to 9, wherein Tf represents a flow of the premix toner. Toner bottle 120 stores developer of premix toner having toner at a rate more than developer stored in the developing device 4. A copier 100 of a tandem type image forming apparatus includes plural toner bottles 120 arranged side by side to store premix toner of different mono colors, respectively, as shown in FIG. 5. Each of the respective toner bottles 120 is connected to a replenishing unit including a sub hopper 68 and a toner pump of a powder pump via a toner replenishing tube 65. The developing device 4 is connected below the replenishing unit. As the toner pump 60, a mohno pump of a screw type including a stator 69 made of elastic member having spiral groves on its cylindrical inner surface and a rotor 61 for conveying the premix toner in an axis direction by its own rotation in the stator 69 is employed. A pump as described in the Japanese Patent Application Laid Open No. 2000-98721 can be employed. As illustrated in FIGS. 6 and 7, the toner bottle 120 includes a toner container 121 and a mouthpiece member 130 attached only to one toner ejection outlet 122.

Figure 8:
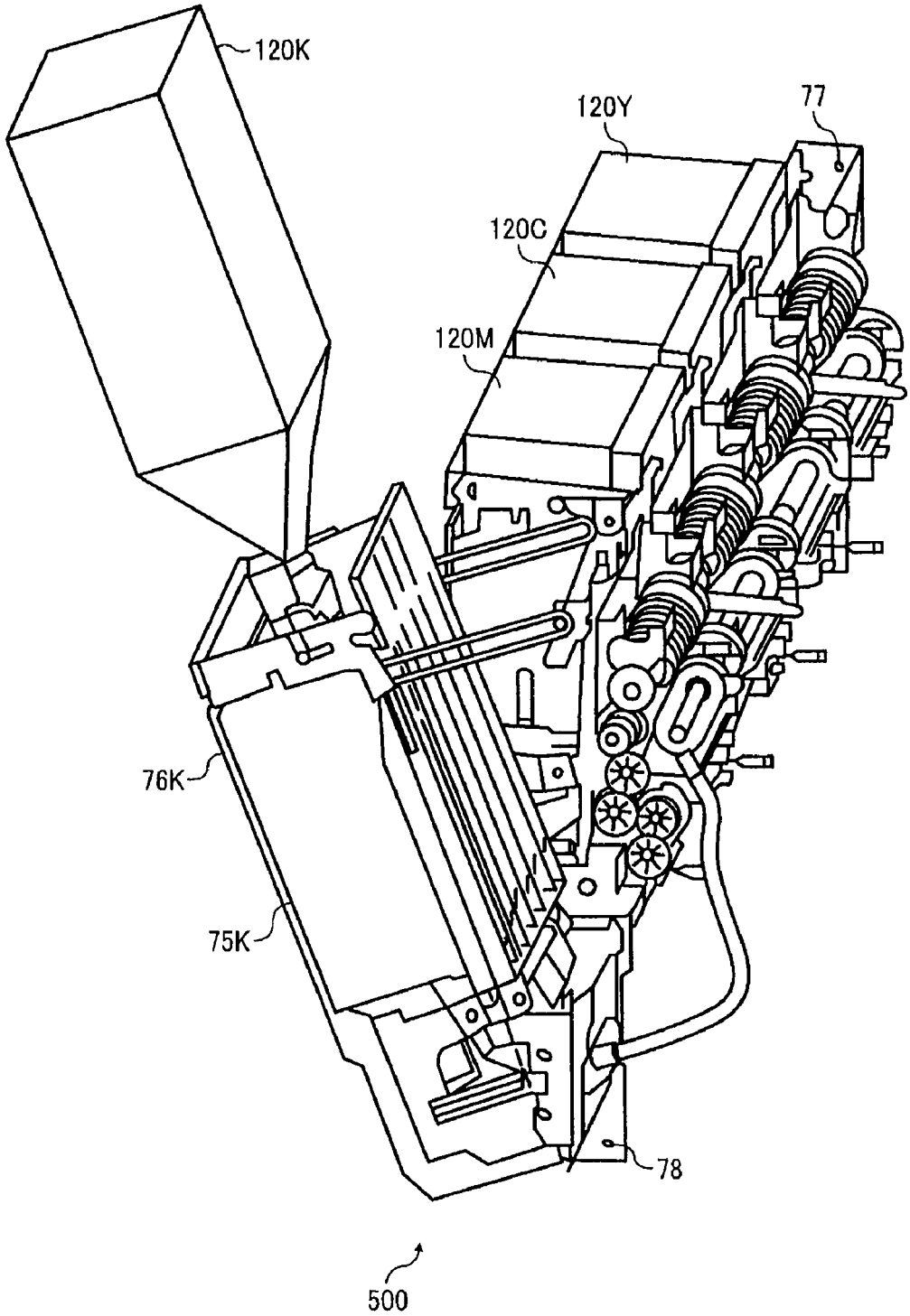
FIG. 8 illustrates an exemplary appearance of a toner bottle for black color use when set to the developing device of FIG. 2.
Figure 9:
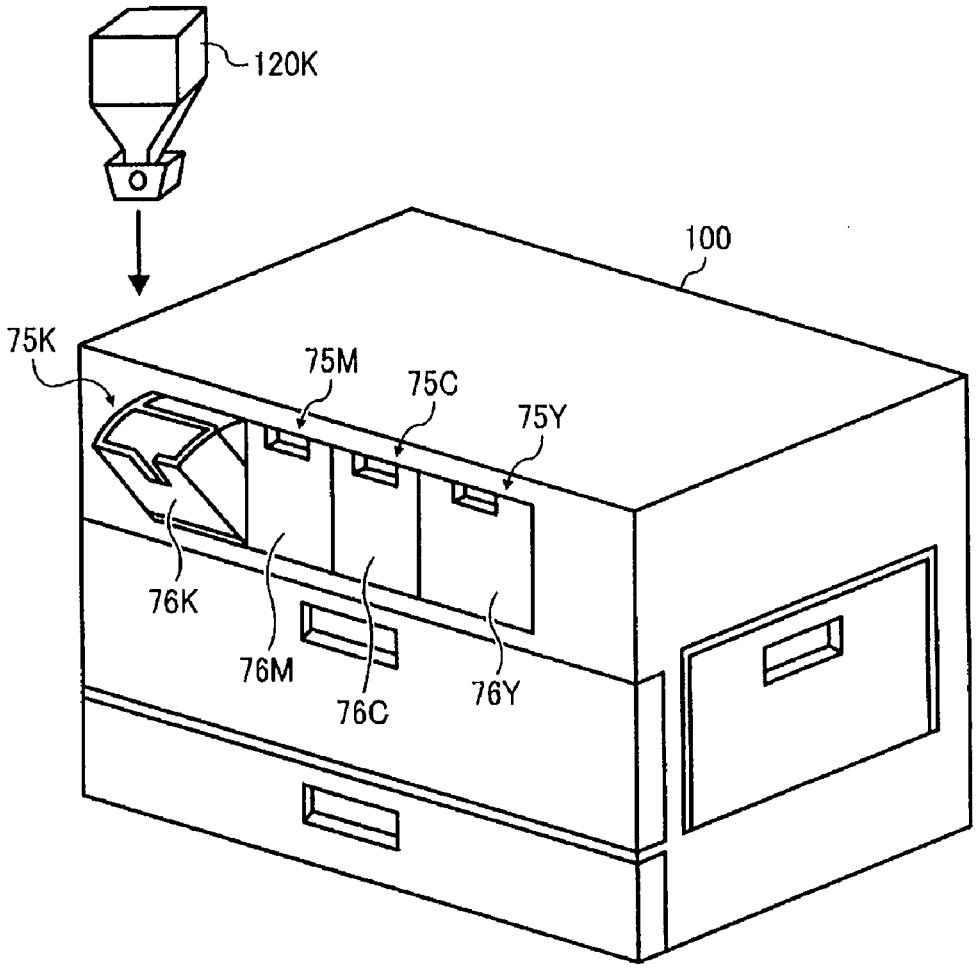
FIG. 9 illustrates an exemplary copier according to one embodiment of the present invention.

The toner replenishing device 500 includes four bottle supporting holders 75Y to 75K swingable around a shaft, not shown, as shown in FIGS. 8 and 9.

The outside surfaces 76Y to 76K of the bottle supporting holders are exposed to the front side of the image forming apparatus as shown in FIG. 9. These bottle supporting holders 75Y to 75K install and support toner bottles 120 for respective mono colors. When an operator attempts to set a toner bottle 120K for black use to the bottle supporting holder 75K, he or she releases a lock, not shown, and withdraws the bottle supporting holder 75K to the front side as shown. Then, the operator grasps and installs the toner bottle 120K into the bottle supporting holder 75K with its mouthpiece member 130 directing downward.

When the toner bottle 120 is set to the bottle-supporting holder 75, a leading end of a nozzle 80 connected to the mouthpiece member 130 is inserted to the toner bottle 120 from the image forming apparatus. Thus, a toner ejection outlet 122 is communicated with a toner reception inlet of the nozzle 80. The nozzle 80 includes a tube connection use joint shape section. The toner replenishing tube 65 is communicated with the toner tube 60. The toner pump 60 is comminuted with the developing device 4 via the sub hopper 68. In this way, when set to the bottle-supporting holder 75, the toner bottle 120 is communicated with the developing device 4.

The toner pump 60 is a screw type, in particular, a suction type uniaxial screw pump. Specifically, the rotor 61 includes a shaft member made of hard material having a circular cross section and twisted in a spiral state, and is connected to the driving motor 66 via a drive transmission and a universal joint 64. The stator 69 is made of soft material and includes a hole having an elliptical cross section also twisted in a spiral state. Further, a spiral interval of the stator 69 is twice as long as a spiral interval of the rotor 61. By engaging these parts while rotating the rotor 61, the premix toner in a gap between the rotor 61 and the stator 69 can be transferred. Specifically, in the toner pump 60, by rotating the rotor 61 and thereby causing the stator to start grinding, a negative pressure is generated at the toner suction inlet 63. By the negative pressure in the toner suction inlet 63, airflow is created inside the toner replenishing tube 65.

When the rotor 61 is driven and rotated, the premix toner in the toner bottle 120 enters the toner pump 60 via the toner suction inlet 63. Then, the premix toner is sucked and conveyed from left to right in the drawing, and is supplied from the toner ejection outlet 67 to the developing device 4 via the hopper 68 and the toner replenishing inlet 95.

As shown in FIG. 8, the toner replenishing device 500 includes a pair of screw holes 77 and 78. Thus, the toner replenishing device 500 is secured to side plates of the image forming apparatus by screwing with screws through the screw holes, not shown.

Figure 10:
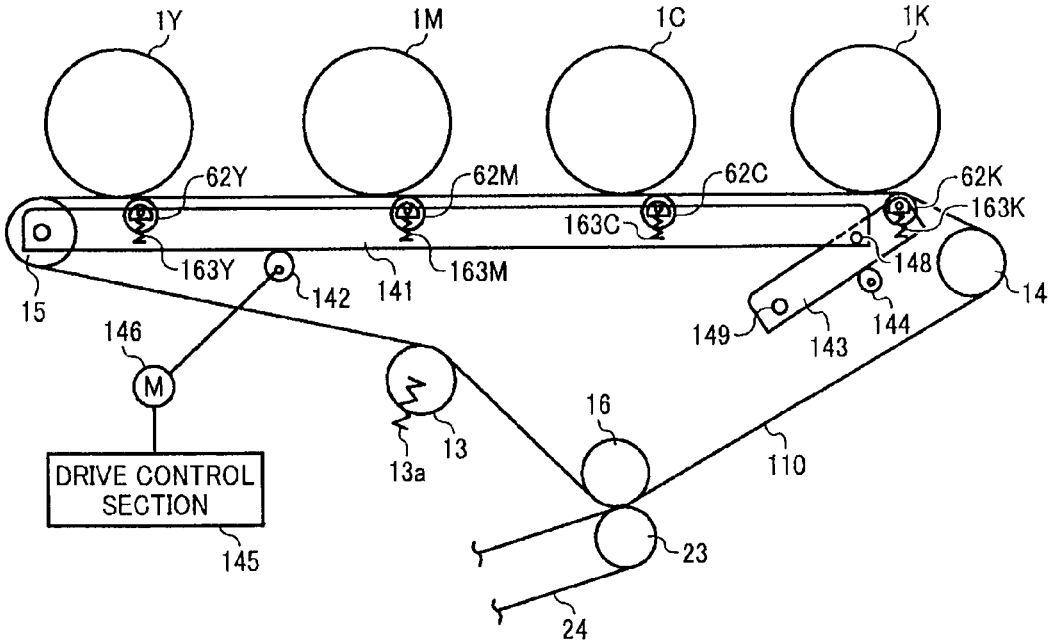
FIG. 10 illustrates an exemplary entire contact mode where an intermediate transfer belt contacts all of the photoconductive members according to one embodiment of the present invention.

An electro photographic color copier according to one embodiment employs a contact and separation device for contacting and separating an intermediate transfer belt 110 from each of the photoconductive members 1. As shown in FIG. 10, the separation device mainly includes a first swinging arm 141 and a first separation cam 142 for collectively contacting and separating the intermediate transfer belt 110 from all of the photoconductive members 1Y to 1C, simultaneously, a second swinging arm 143 and a second separation cam 144 for collectively contacting and separating the intermediate transfer belt 110 only from the photoconductive member 1K. The first separation cam 142 is driven and rotated by a separation motor 146 controlled by a control signal transmitted from a driving control section 145. The second separation cam 144 is driven and rotated when a lever attached to a leading end of a camshaft 144 is manually operated.

One end of the first swinging arm 141 is supported by a swinging fulcrum 148 arranged on the black use primary transfer roller 62K side of a middle point of the second swinging arm 143. Since the second swinging arm 143 swings, the swinging fulcrum also swings. Between the swinging fulcrum 148 and the supporting roller 15, three primary transfer rollers 62Y to 62C are relatively supported being biased by the pressure applying springs 163Y to 163C toward the photoconductive members 1Y to 1C. The first swinging arm 141 is contacted by the first separation cam 142 on an opposite side in which three primary transfer rollers 62Y to 62C are arranged and on the supporting roller 15 side of the middle point of the first swing arm 141. Thus, when the first separation cam 142 rotates, the first swinging arm 141 swings around the swinging fulcrum 148. As a result, the three primary transfer rollers 62Y to 62C and the intermediate transfer belt 110 can contact and is separated from the three photoconductive members 1Y to 1C.

The second swinging arm 143 is swingably supported by an intermediate transfer unit frame, not shown, around a swinging fulcrum 149 as a rotary center arranged at one end thereof.

On the other end, the black use primary transfer roller 62K is arranged. The black use primary transfer roller 62K is swingably supported being biased by a pressure applying spring 163K toward the black use photoconductive member 1K. The second singing arm 143 is contacted by the second separation cam 144 on the black use primary transfer roller 62K side of its lengthwise middle point and on an opposite side of the black use photoconductive member 1K. Thus, when the second separation cam 144 rotates, the second swinging arm 143 swings around the swinging fulcrum 149. As a result, the black use primary transfer roller 62K and the intermediate transfer belt 110 can contact and are separated from the photoconductive member 1K.

Figure 11:
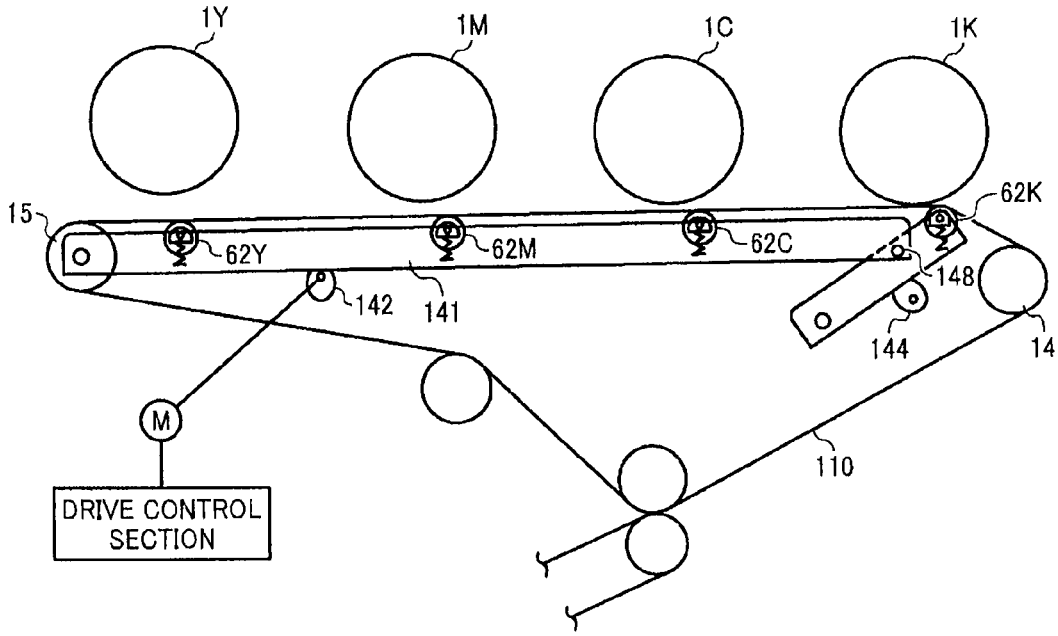
FIG. 11 illustrates an exemplary partial separation mode where the intermediate transfer belt partially contacts the photoconductive members except for that for black color use according to another embodiment of the present invention.

FIG. 11 illustrates an exemplary partial contact and separation mode where the intermediate transfer belt 110 partially contacts the photoconductive members, i.e., the photoconductive member 1K for black color use is only contacted. By rotating the first separation cam 142 by the angle of 180 degree from the position as shown in FIG. 10, the first singing arm 141 swings downward around the swinging fulcrum 148 in the drawing, and the primary transfer rollers 62Y to 62C are separated from three photoconductive members 1Y to 1C, respectively, so that the intermediate transfer belt 110 is separated from the three photoconductive members 1Y to 1C. As a result, the partial separation mode is provided and a black mono color image can be formed. In this partial separation mode, since the intermediate transfer belt 110 only contacts the black photoconductive member 1K and is separated from remaining photoconductive members 1Y to 1C, these photoconductive members 1Y to 1C can avoid deterioration caused by the contact. Further, since these photoconductive members 1Y to 1C can stop operating, the charger device, the developing device 4 and the cleaning device or the like can prolong their live spans.

Figure 12:
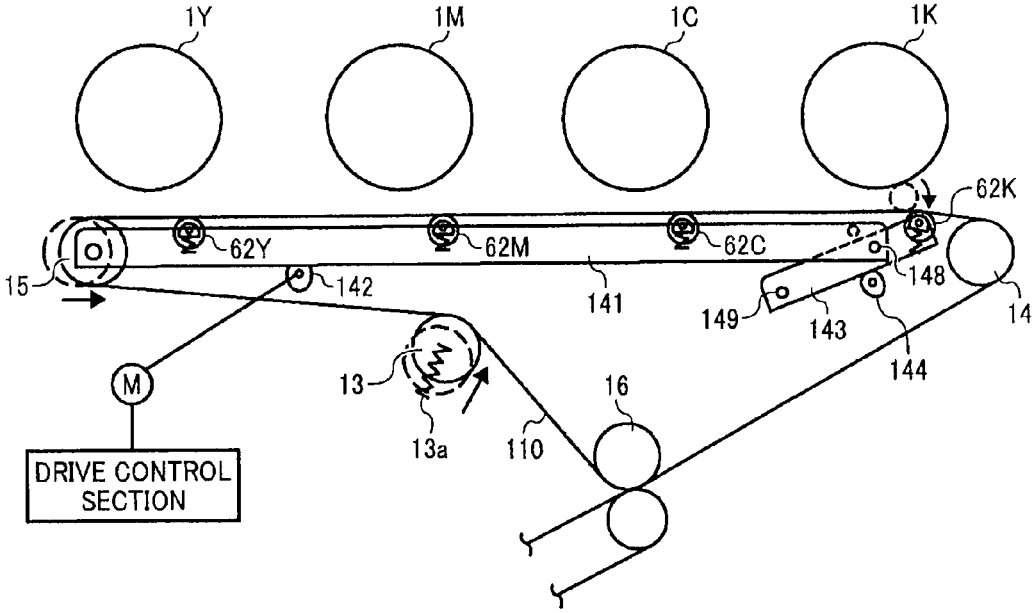
FIG. 12 illustrates an exemplary entire separation mode where the intermediate transfer belt is entirely separated from the photoconductive members according to one embodiment of the present invention.

FIG. 12 illustrates an exemplary condition where the intermediate transfer belt 110 is separated from the black use photoconductive member 1K beside the other photoconductive members 1Y to 1K. When developer is to be replenished to a vacant developing device as mentioned later, the intermediate transfer belt 110 is separated from all of the photoconductive members 40C to 40Bk. Further, the intermediate transfer belt 10 is separated from all of the photoconductive members 40C to 40Bk when shipped from a factory. Specifically, when an image forming apparatus is delivered to a user, a service person operates a lever to provide a partial separation condition to execute an initial operation as shown in FIG. 11. When the second separation cam 144 is rotated by half from the state of FIG. 11, the second swinging arm 143 swings around the swinging fulcrum 149 as a swinging center, while the black use primary transfer roller 62K is separated downward from the black use photoconductive member 1K, so that the intermediate transfer belt 110 parts from the black use photoconductive member 1K. As a result, the intermediate transfer belt 110 is separated from all of the photoconductive members 1Y to 1K. Since the swing fulcrum side of the first swing arm 141 supported by the second swing arm 143 at its one end inclines downward, the first swing arm 141 moves downward in parallel to the previous state thereof as shown in FIG. 11. If the swing fulcrum 148 is not connected to the second swing arm 143, the first swing arm 141 inclines to the left lower side in the drawing. At same time, since the cyan use primary transfer roller 32C most closely approaches the cyan use photoconductive member 1C, a gap between the intermediate transfer belt 110 and the cyan use photoconductive member 1C becomes smaller than that of others 1Y and 1M.

The developer in the developing device 4 needs to be periodically replaced due to deterioration caused by usage for a long time. Thus, the service person calls on the user and collects old developer and replenishes fresh developer in a vacant developing device. Collection of the old developer is executed by detaching the developing device 4 from the image forming apparatus 100 and collecting old developer via the toner replenishing inlet 95 as shown in FIG. 4. Otherwise, a developer ejection outlet is provided at the bottom of the developing device while providing a shutter to open and close the developer ejection outlet. Then, a hind menu is displayed on an operation display, not shown, and a developer ejection mode is selected and executed. When this mode is to be performed, the shutter can open and each of the screws is driven rotated, so that the old developer in the developing device can be collected via the developer ejection outlet. Further, when the old one is collected from the developing device, fresh developer is replenished to the developing device. Further, when a copier is shipped with a developing device fulfilled with developer, the developer sometimes leaks from an opening of the developing device due to vibration or inclination of the image forming apparatus during transportation and the developer contacts the open air resulting in deterioration. Thus, the developer is generally replenished to the developing device when the image forming apparatus 100 arrives at the user site.

Figure 13:
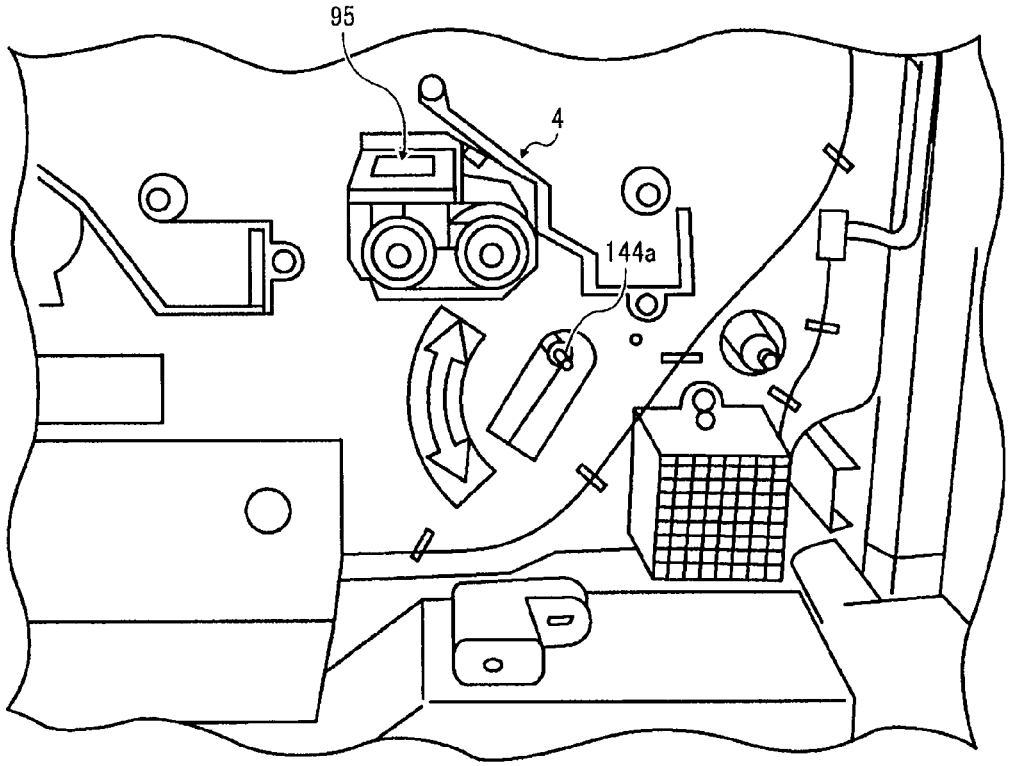
FIG. 13 illustrates an exemplary copier when a toner replenishment device is withdrawn therefrom according to one embodiment of the present invention.
Figure 14:
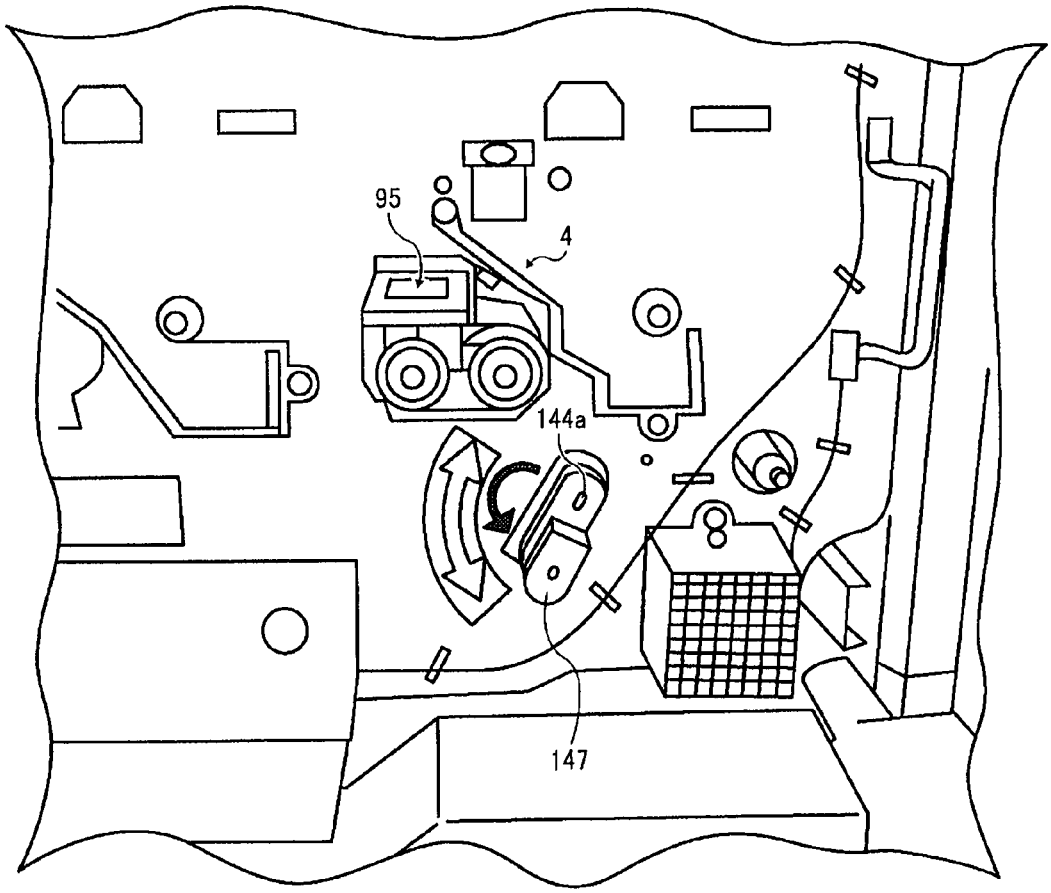
FIG. 14 illustrates an exemplary appearance when an exemplary lever is attached to a camshaft of a second separation cam according to one embodiment of the present invention.
Figure 15:
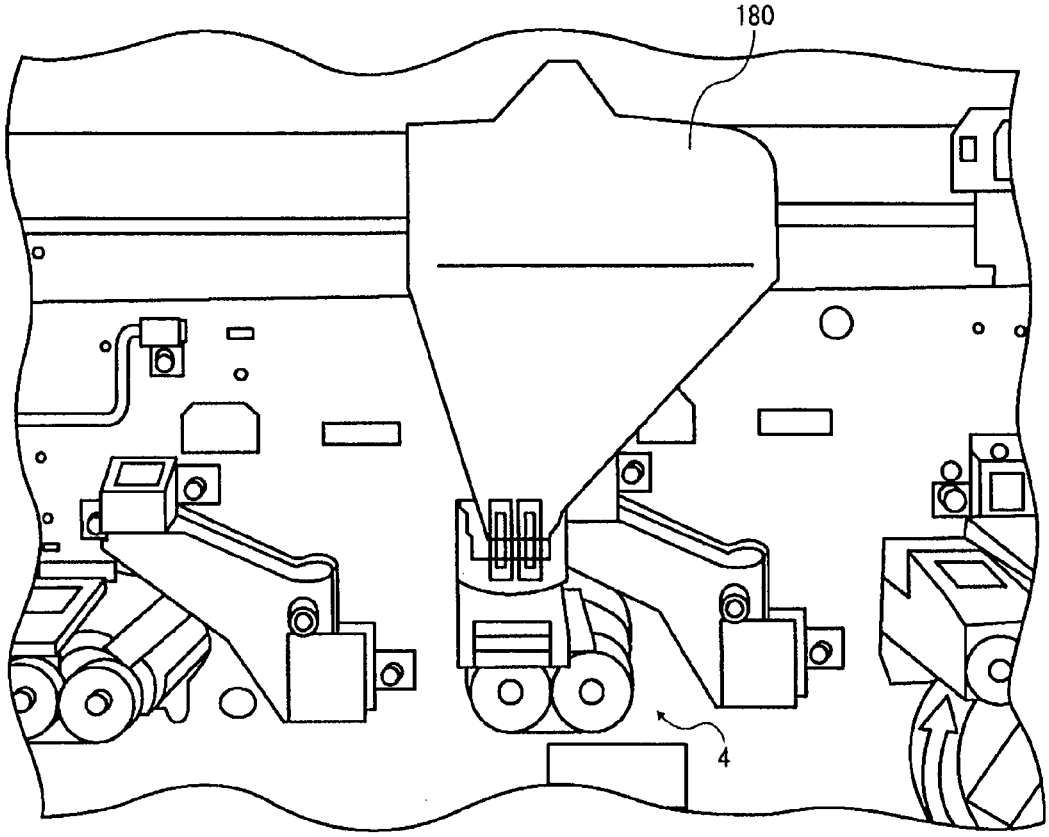
FIG. 15 illustrates an exemplary appearance when an exemplary developer bottle is attached to an exemplary toner replenishing inlet of the developing device according to one embodiment of the present invention.

Exemplary replenishment of developer to the developing device 4 is executed as follows. Initially, a front door of the image forming apparatus 100 is open and a main power supply is tuned off. Then, a toner replenishing device 500 screwed to side plates of the image forming apparatus 100 is detached therefrom. Each of the toner replenishing inlets 95 of the developing devices is then exposed as shown in FIG. 13. Then, as shown in FIG. 14, a lever 147 attached to a leading end of the camshaft 144*a* of the second separation cam is swung counterclockwise in the drawing, so that the intermediate transfer belt 110 is separated from all of the photoconductive members 1Y to 1K. Then, as shown in FIG. 15, the developer bottle 180 is set in a manner such that the developer-replenishing inlet of the developer bottle 180 storing the developer engages with the toner-replenishing inlet 95. As an initially operation executed when the copier 100 is delivered to the user, four developer bottles 180Y to 180K are set to toner replenishing inlets of corresponding colors, respectively. In a replacement operation of replacing the developer, a developer bottle 180 is set to the toner replenishing inlet of the developing device from which the developer has been collected. Then, a heat seal, not shown, sealing the developer replenishing inlet is peeled off, and the front door of the copier 100 is closed. Then, the main power supply is turned on. By bringing a hind menu on the operation panel, a color corresponding to a developer bottle 180 being set is selected and a developer-replenishing mode is selected and executed. As the initial operation, all colors are selected and the developer-replenishing mode is designated and executed. When this mode is executed, each of the screws is driven rotated, and the developer supplied from the developer bottle through the toner-replenishing inlet 95 is conveyed and uniformly enters the developing device. Further, the photoconductive member 1 is simultaneously driven and rotated not to be damaged by fresh carrier adhering to the developing roller. When the photoconductive member 1 is continuously rotated without supplying toner to the cleaning blade, the cleaning blade can roll up. Thus, when some developer is replenished, a band shape cleaning input image is formed on the photoconductive member 1 so that the toner is supplied to the cleaning blade. When all of colors are selected and the developer-replenishing mode is designated, color developers Y to K are replenished in this order. All of the color developer Y to K can be replenished at the same time.

In this way, when the developer-replenishing mode is completed, the main power supply of the image forming apparatus 100 is turned off, and the front door is open. When it is confirmed that the developer in the developer containing bottle is entirely replenished to the developing device, the developer containing bottle is detached and the toner replenishing device 500 is attached to the image forming apparatus 100. After that, the front door is closed and the main power supply is turned on. Then, a service person operates the operation display panel, not shown, and executes an initial setting operation, such as collection of sensitivity of a toner density sensor, not shown, an image formation condition, etc., for obtaining appropriate image density. Correction of sensitivity of the toner density sensor is executed as follows. Density of toner replenished to and stored in the developing device amounts to about 7%, because the density of toner in the developer bottle is 7% in this embodiment. Thus, by adjusting an output of the toner density sensor to have a value corresponding to the toner density of 7%, sensitivity of the toner density sensor is corrected.

Further, in the image forming apparatus from which a process unit having a developing device storing deteriorated developer and a photoconductive member is replaced with a new process unit not storing developer in the developing device when the developer deteriorates, sensitivity of the photoconductive member is corrected as an initial setting operation beside the sensitivity of the toner density sensor. The sensitivity of the photoconductive member is corrected by gradually changing an exposure power and forming a latent image on the photoconductive member while measuring a voltage of the latent image with a potential sensor, so that sensitivity is corrected.

When the initial setting operation is completed, the front door is open and the lever 147 is swung. Then, the entire separation mode is changed to the partial separation mode of FIG. 11, and the front door is closed, thereby a series of operations executed when developer is replenished to the vacant developing device is completed.

In the above, the mode is manually changed to the entire separation mode using the lever 147. However, a second separation cam motor is provided to drive and rotate the second separation cam so that the mode is automatically changed to the second separation mode.

Figure 16:
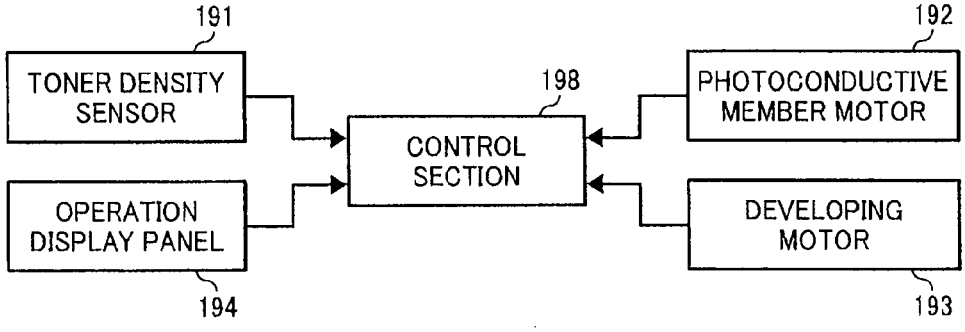
FIG. 16 illustrates an exemplary electric circuit that controls a copier according to one embodiment of the present invention.

Now, an exemplary electric circuit of a copier as the image forming apparatus 100 is described with reference to FIG. 16. The control section 198 includes a CPU, a RAM, and a ROM or the like. The control section 198 generally controls the copier and is connected to various devices and sensors as shown. The control section 198 achieves various functions based on control program stored in the RAM and ROM. Specifically, upon receiving an instruction to execute a developer replenishing mode from the operation panel 194, the control section 198 drives a photoconductive member motor 192 and a developer motor 193, thereby functioning as a developer replenishing device for replenishing the developer. Further, as mentioned later in detail, the control section 198 serves as a switching device for switching a permission condition for permitting execution of replenishing of developer to a prohibition condition for prohibiting the execution thereof, vice versa.

Now, one embodiment of the present invention is described in more detail. When a developer bottle is erroneously set to a different section, or developer is replenished to a developing device yet having developer, thereby a duplicate replenishing is executed, the developer sometimes leaks from the developing device. Otherwise, the developer remains in the developer bottle 180 and sometimes drops in the copier 100 when the developer bottle 180 is detached. Thus, the copier 100 is contaminated and fatally damaged.

It is preferable that the developer replenishing operation is performed only when the developer is used up in the developing device. However, the following problems are raised. Specifically, a power supply is accidentally turned off during the developer replenishing operation, or the developer clogs in the developer bottle. As a result, the developer in the developer bottle is sometimes not entirely replenished to the developing device. In such a situation, even attempted again to replenish, the developer replenishing operation is impossible, because some of the developer has already been replenished. To avoid such problems, a sensor is provided in the developer containing section to detect the developer in the developer bottle, for example. Specifically, it is detected if the developer in the developer bottle is entirely replenished to the developing device. Then, the developer replenishing operation is permitted until the developer disappears in the developer bottle. However, in such a situation, parts like sensors are needed to detect the developer in the developer bottle, thereby a number of parts increases and the copier becomes expensive. Further, a condition of the copier 100 is switched to a permission condition capable of replenishing developer when it is determined that the developer does not remain in the developing device. Thus, a service person may operate the operation panel and switches from the permission condition to a prohibition condition for prohibiting the replenishment thereof when the developer in the developer bottle is entirely replenished to the developing device. However, if the service person forgets such an operation of switching to the prohibition condition, the duplicate replenishing may possibly occur.

Then, according to this embodiment, to prevent such a problem of forgetting designation of the prohibition condition, a control section automatically switches to the prohibition condition when a prescribed operation is executed subsequent to completion of entire replenishment of the developer from the developer bottle to the developing device. The above-mentioned prohibition condition means that the developer replenishment is not started even if a service person or a user operates the display operation panel and designates a developer-replenishing mode.

Figure 17:
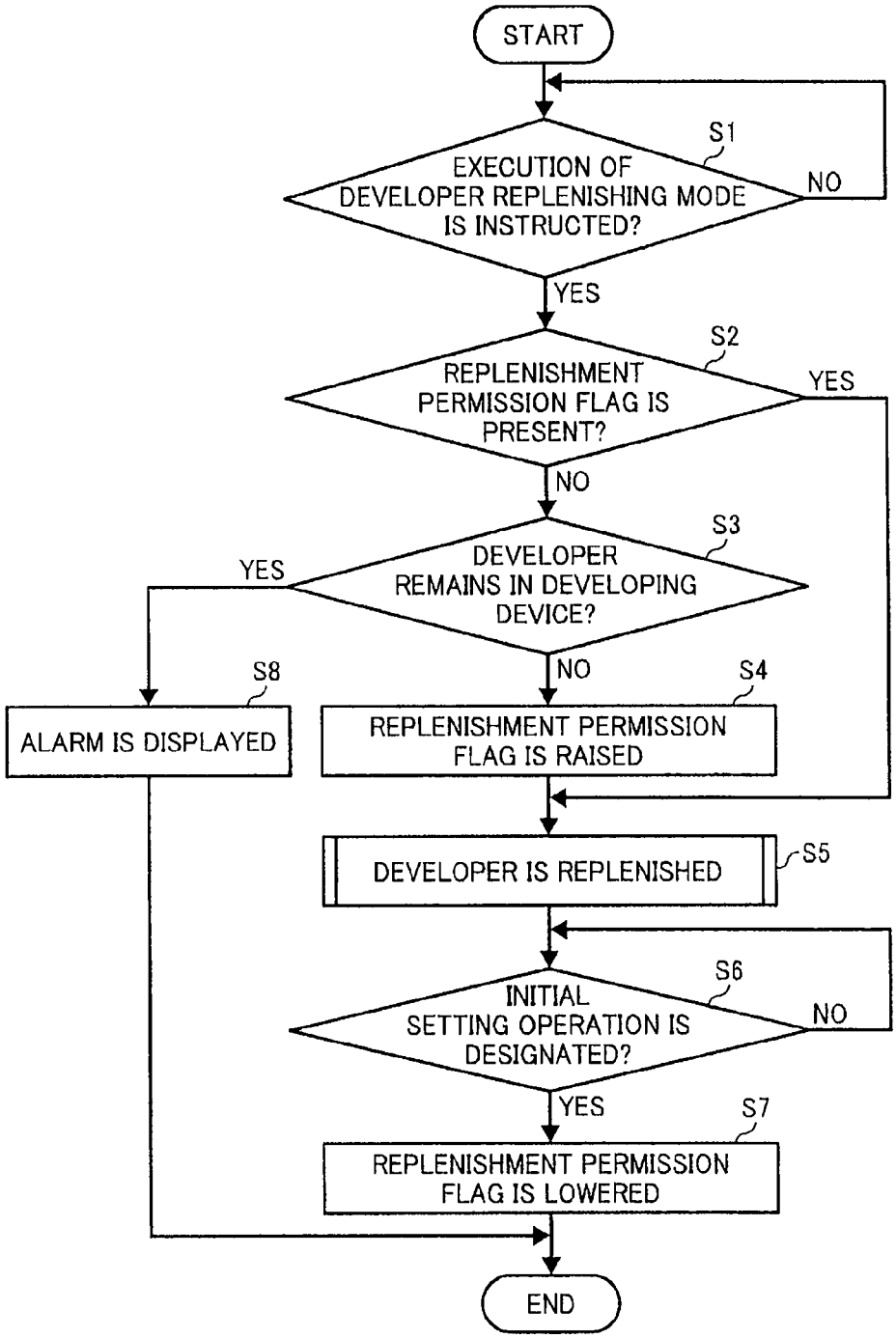
FIG. 17 illustrates a first exemplary control sequence according to one embodiment of the present invention.

Now, a first embodiment is described with reference to FIG. 17. A permission condition for permitting a developer replenishing operation is switched to a prohibition condition prohibiting the developer replenishing operation. When a service person operates an operation display panel 194 and designates a developer-replenishing mode (Yes, in step S1), the control section 198 determines if a replenishment permission flag is raised in step S2. If the replenishing flag is not raised and thus the developer replenishing operation is in the prohibition condition and thus the determination is negative (No, in step S2), it is then determined if the developer remains in the developing device in step S3.

Whether or not the developer remains in the developing device is detected based on an output value Vt of the toner density sensor 191. The toner density sensor 191 is a magnetic permeability type and outputs a high voltage Vt when many carriers are included in a detection range of the toner density sensor 191 and thereby raising magnetic permeability, and accordingly toner density is low. Whereas when toner density is high, the output value Vt becomes low, because a lot of carrier is not included in the detection range and the magnetic permeability is lowered.

Thus, when the output value Vt of the toner density sensor 191 is significantly low, it can be determined that the developing device stores no developer. In such a situation, the toner density sensor 191 serves as a developer replenishing detection sensor.

Further, based on a torque of a developing motor for driving conveyance means, such as a developing roller 5, a supply screw 8, a collection screw 6, and a stirring screw 11, etc., it can be determined if the developing device stores the developer. Specifically, when the developing device stores developer, the torque of the conveyance members increases, where as when the developing device does not store developer, the torque thereof decreases. Thus, when the torque of the developing motor 193 is relatively low, it can be determined that the developing device does not store the developer. The torque can be detected by using a developing motor torque detection sensor that monitors a drive current of the developing motor 193 and converts it into torque. That is, the developing motor torque detection sensor serves as a replenishing detection sensor.

Further, whether or not the developing device stores developer can also be determined by forming a developer presence detection pattern on a photoconductive member and detecting an amount of toner adhering to the developer presence detection pattern. Specifically, when the developing device stores the developer, toner sticks to a latent image of the developer presence detection pattern. Where as when the developing device substantially does not store the developer, since the toner does not stick to the latent image, the toner-sticking amount cannot be detected. Thus, based on the result of detecting an amount of toner sticking to the developer presence detection pattern, it can be determined whether the developing device stores the developer. In such a station, an image formation unit for forming a developer presence detection pattern on a photoconductive member and an adhering amount detection device for detecting an amount of toner sticking to the photoconductive member collectively serve as a replenishment detection device.

In this way, when it is determined that the developer device does not store the developer (No, in step S3), the control section 198 raises a replenishing permission flag in step S4, and switches from the prohibition condition to the permission condition, thereby executing a developer replenishing operation to replenish the developer from the developer bottle 180 set to the developing device in step S5. Further, information of the replenishing permission flag is stored in a non-volatile memory such as a RAM, etc. When it is detected that the developing device stores developer (Yes, in step S3), an alarm may be displayed on the operation display panel 194 or the like indicating that the developing device stores the developer in step S8, thereby the sequence is terminated. Thus, when the developing device stores deteriorated developer, since the developer is not replenished from the developer bottle 180, the duplicate replenishment caused by an error of a service person can be prevented.

Whereas when the developer replenishing flag is raised (Yes, in step S2), a developer replenishing operation is executed in step S5 without detecting if the developing device stores developer. Thus, when the developer replenishing flag is raised and the developer in the developer bottle is not entirely replenished to the developing device because of turning off of the power supply or clogging of the developer in the developer bottle, a service person can operate the operation display panel 194 and maintains designation of the developer replenishing mode.

Thus, the developer replenishing operation is executed without detecting if the developing device stores the developer. Thus, even when either the power supply of the copier is turned off or the developer in the developer bottle clogs, and accordingly, some of the developer is replenished in the developing device, the developer replenishing operation can be continued. As a result, the developer in the developer bottle is entirely replenished to the developing device. Further, when stored in a nonvolatile memory since the information of the replenishing permission flag does not disappear even when the power supply is turned off during the developer replenishing operation, the developer replenishing operation can be executed again.

When the service person confirms that the developer in the developer bottle is entirely replenished to the developing device, and designates the above-mentioned initial setting operation by operating the operation display panel 198 (Yes, in step S6), the control section 198 automatically lowers the replenishing permission flag in step S7, and switches from the replenishment permission condition to the replenishment prohibition condition in step S7. Since the initial setting operation mode is always automatically executed after completion of replenishment of the entire developer from the developer bottle to the developing device, the developer replenishment permission condition is credibly switched to the replenishment prohibition condition by lowering the replenishing permission flag after the completion of replenishment of the entire developer. Thus, the replenishing permission flag is credibly prevented from being raised when a developer-replenishing mode is executed next time. Thus, when a developer-replenishing mode is executed to replace developer next time, a detection step for detecting if the developing device stores deteriorated developer is always included, so that the duplicate replenishing is credibly prevented.

Figure 18:
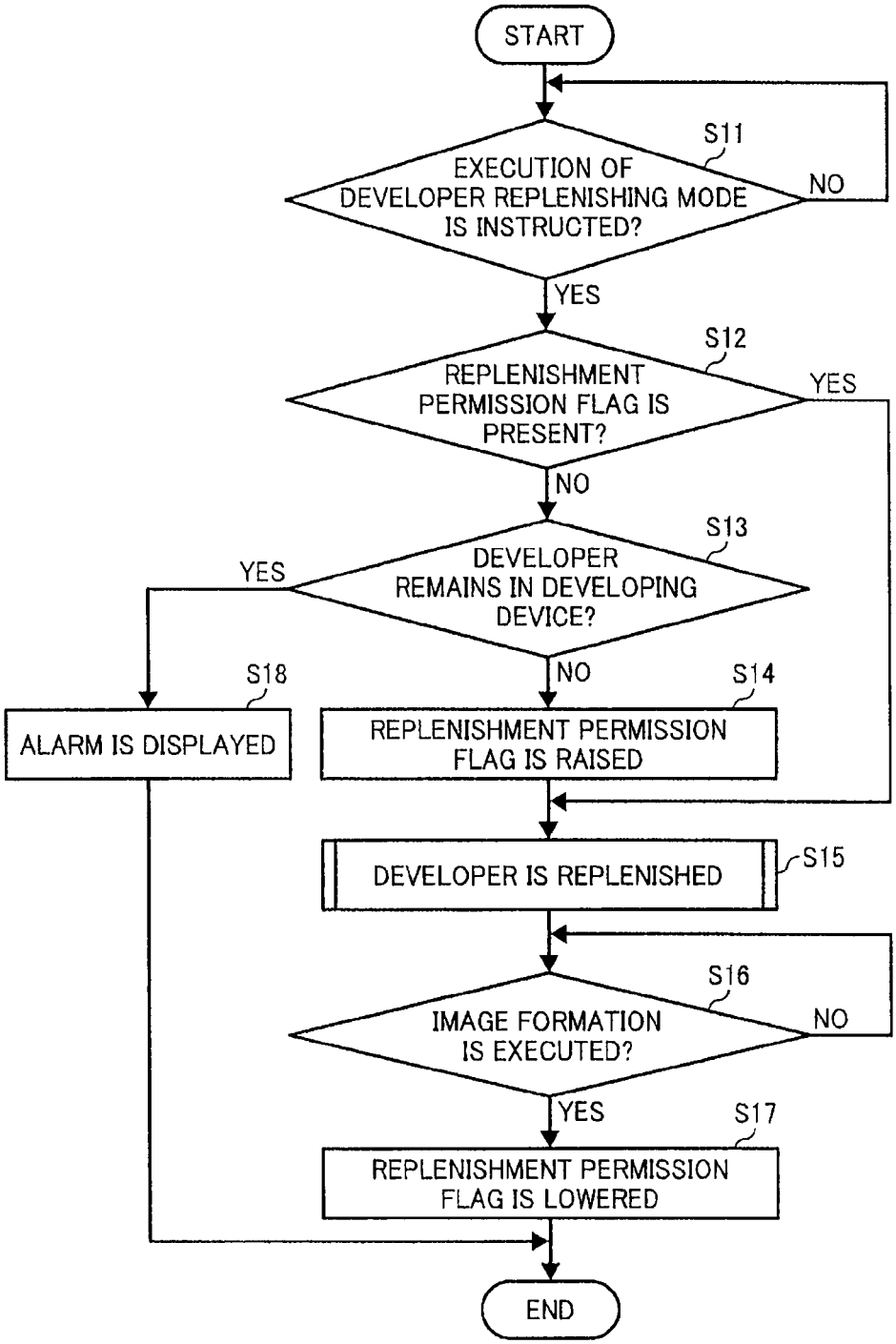
FIG. 18 illustrates a second exemplary control sequence according to another embodiment of the present invention.

Now, the second embodiment is described with reference to FIG. 18. The second embodiment features that when developer in the developer containing bottle is entirely replenished to the developing device and an image formation operation is executed, a developer replenishment permission condition is switched to a developer replenishment prohibition condition. Specifically, similar to the first embodiment, the control section 198 detects if a replenishment permission flag is raised in step S12 when a service person designates a developer-replenishing mode (Yes, in step S11). When the replenishing permission flag is raised (Yes, in step S12), a developer replenishing operation is executed regardless of existence of the developer in the developing device. Whereas, when the replenishment permission flag is not raised (No, in step S12), the control section 198 detects if the developing device stores the developer in step S13. When the developing device stores the developer (Yes, in step S13), alarm is displayed on the operation display panel 194. Where as when the developing device does not store the developer (No, in step S13), a replenishment permission flag is raised and the developer replenishing operation is executed.

When the developer is entirely replenished from the developer containing bottle to the developing device by the developer replenishing operation and initial setting and image formation operations, such as ejection of a printing sheet from a copier, etc., are then executed (Yes, in step S16), a developer replenishing permission flag is lowered in step S17.

Since the image formation operation is always executed and lowers the replenishment permission flag after entire replenishment of the developer from the developing bottle to the developing device, the replenishment permission condition is credibly switched to the replenishment prohibition condition. Thus, when a developer-replenishing mode is executed to replace the developer next time, the replenishing permission flag is credibly prevented from being raised. Thus, whenever the developer-replenishing mode is execute to replace the developer next time, a detection operation for detecting if the developing device stores deteriorated developer is executed, so that the duplicate replenishing can credibly be prevented.

Figure 19:
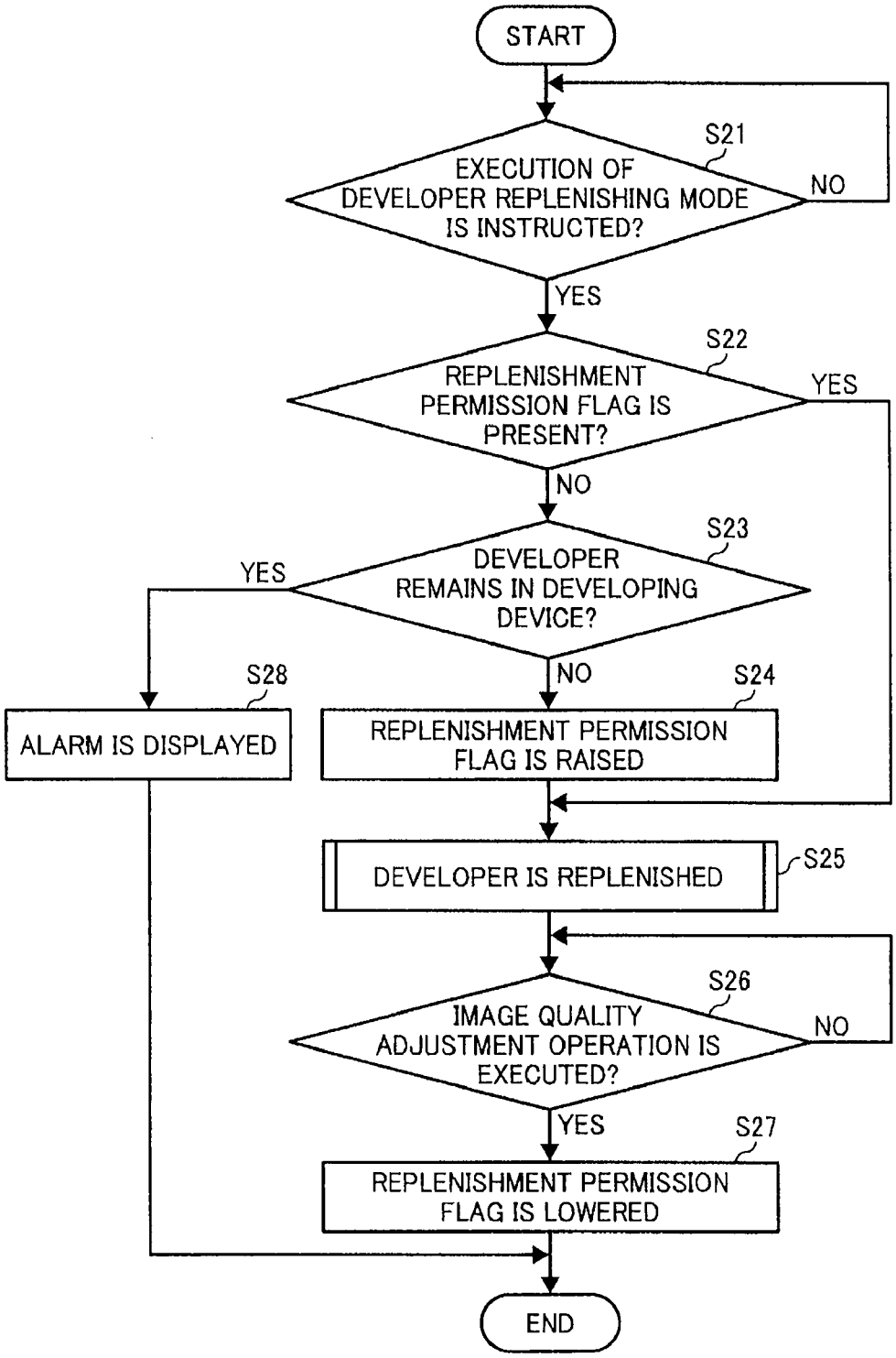
FIG. 19 illustrates a third exemplary control sequence according to yet another embodiment of the present invention.

The third embodiment is now described with reference to FIG. 19, in which a control sequence of switching a replenishment permission condition to a replenishment prohibition condition is described. When an image quality adjustment operation is executed after developer is entirely replenished from a developer containing bottle to a developing device (Yes, in step S26), a replenishment permission flag is lowered in step S27, so that a replenishment permission condition is switched to a replenishment prohibition condition. The image quality adjustment operation is executed, for example, when a number of images reach a prescribed level in which image quality or a process unit is supposed to deteriorate due to a change in environmental condition. Specifically, image quality adjustment patterns having a different toner adhering amount may be formed on an intermediate transfer belt, and is detected by an adhering amount detection sensor. To obtain a prescribed image density, a developing bias, a charge bias, and an exposure power or the like are adjusted based on the detection result of the adhering amount detection sensor.

Since the image quality adjustment is always executed after the entire replenishment of the developer from the developer bottle to the developing device, the replenishment permission condition is credibly switched to the replenishment prohibition condition by lowering the replenishment permission flag.

Thus, when a developer-replenishing mode is executed next time to replace developer, the replenishing permission flag is credibly prevented from being raised. Specifically, a detection step for detecting if the developing device stores deterioration developer is included, so that the duplicate replenishing can be credibly prevented.

As mentioned heretofore, the image forming apparatus of this embodiment includes the photoconductive member. The developing device is included to develop a latent image formed on the photoconductive member with the developer stored in the developer containing section. The control section serves as a developer-replenishing device for replenishing the developer from the developer containing bottle 180 to the developer containing section. The control section also serves as a detection device including a detection sensor for detecting if the developer containing section stores the developer. The control section also serves as a switching device for switching from a replenishment prohibition condition to a replenishment permission condition when the replenishment detection device detects that developer is not stored in the developer containing section, and switching from the replenishment permission condition to the replenishment prohibition condition when a prescribed operation executed after the developer is entirely replenished from the developer container bottle to the developer containing section. Thus, since the replenishment prohibition condition is not switched to the replenishment permission condition unless the developer containing section is vacant, the developer is prevented from being replenished from the developer containing bottle to the developer containing section when developer is stored in the developer containing section. Further, since the replenishment permission condition is not switched to the replenishment prohibition condition unless both the developer is entirely replenished from the developer container bottle to the developer containing section and the prescribed operation is then executed, a developer replenishing operation can be executed again regardless of whether the developer is stored in the developer containing section. Thus, the developer in the developer container bottle can be entirely replenished. Further, since the replenishment permission condition is automatically switched to the replenishment prohibition condition only after the developer is entirely replenished from the developer container bottle and the prescribed operation is then executed, a service person does not need to switch the copier 100 to the replenishment prohibition condition. Thus, when the next developer replacement operation is to be executed, a developer replenishing operation is credibly prohibited unless the developer containing section is vacant. Thus, the duplicate replenishing of the developer possibly caused by an error of the service person can be credibly prevented.

Further, since the information as to if the replenishing permission flag is raised is stored in the non-volatile memory, information related to the replenishment permission or prohibition can be maintained even if the power supply of the image forming apparatus is turned off. Thus, even if the power supply of the image forming apparatus is turned off during the developer replenishing operation, the developer replenishing operation can be executed again regardless if the developer containing section stores the developer.

According to the first embodiment, since the initial setting operation is always executed after the developer is entirely replenished from the developer containing bottle to the developer containing section, and the replenishment permission condition is credibly switched to the replenishment prohibition condition after the initial setting operation.

According to the second embodiment, since the image formation operation is always executed after the developer is entirely replenished from the developer container bottle to the developer containing section, the replenishment permission condition is credibly switched to the replenishment prohibition condition after the image formation operation.

According to the third embodiment, since the image quality adjustment operation is always executed after the developer is entirely replenished from the developer containing bottle to the developer containing section, the replenishment permission condition is credibly switched to the replenishment prohibition condition after the image quality adjustment operation.

Obviously, numerous additional modifications and variations of the present invention are possible in light of the above teachings. It is therefore to be understood that within the scope of the appended claims, the present invention may be practiced otherwise than as specifically described herein.

What is claimed is:

1. An image forming apparatus, comprising:

a latent image carrier configured to carry a latent image;

a developing device configured to develop the latent image with developer;

a developer containing section included in the developing device and configured to contain and stir the developer;

a developer containing bottle attached to the image forming apparatus and configured to store developer;

a developer replenishing device included in the developing device and configured to replenish the developer from the developer containing bottle to the developer containing section based on a replenishment instruction of an operator through an inputting device;

a replenishment detection device configured to detect if the developer containing section stores the developer; and a controller configured to switch from a developer replenishment prohibition mode to a developer replenishment permission mode when the replenishment detection device detects that the developer containing section does not store a prescribed amount of the developer, and switch from the developer replenishment permission mode to the developer replenishment prohibition mode when a prescribed operation other than replenishment of the developer is executed upon completion of replenishment of the developer from the developer containing bottle to the developer containing section, said developer replenishment prohibition mode prohibiting the developer replenishment device from replenishing the developer to the developer containing section, and said developer replenishment permission mode permitting the developer replenishment device to replenish the developer to the developer containing section, wherein said controller invalidates the replenishment instruction in the developer replenishment prohibition mode and validates the replenishment instruction in the developer replenishment permission mode.

2. The image forming apparatus as claimed in claim 1, further comprising a non-volatile memory, wherein said controller controls the non-volatile memory to store information of the prohibition and permission modes.

3. The image forming apparatus as claimed in claim 1, wherein said prescribed operation includes an initial setting operation for adjusting sensitivity of a prescribed sensor.

4. The image forming apparatus as claimed in claim 1, wherein said prescribed operation includes an image forming operation.

5. The image forming apparatus as claimed in claim 1, wherein said prescribed operation includes an image quality adjustment operation.

6. A method for replenishing developer from a developer containing bottle storing developer to a developer containing section included in a developing device, said method comprising the steps of:

detecting if developer is stored in the developer containing section;

switching from a developer replenishment prohibition mode, in which replenishment of the developer from the developer containing bottle to the developer containing section is prohibited, to a permission mode, in which replenishment of the developer from the developer containing bottle to the developer containing section is permitted, when it is detected that a prescribed amount of the developer is not stored in the developer containing section;

replenishing the developer from the developer containing bottle to the developer containing section based on a replenishment instruction of an operator through an inputting device; and automatically switching from the developer replenishment permission mode to the developer replenishment prohibition mode when a prescribed operation other than replenishment of the developer is executed upon completion of replenishment of the developer from the developer containing bottle to the developer containing section, wherein the replenishment instruction is invalidated in the developer replenishment prohibition mode and the replenishment instruction is validated in the developer replenishment permission mode.

7. The method as claimed in claim 6, wherein said step of automatically switching from the developer replenishment permission mode includes a sub step of executing one of initial setting, image formation, and image quality adjustment as the prescribed operation.

* * * * *